US009198527B2

(12) United States Patent
Goehring

(10) Patent No.: US 9,198,527 B2
(45) Date of Patent: Dec. 1, 2015

(54) SPACE SAVING MANUAL SHELF MANAGEMENT SYSTEM

(71) Applicant: William R. Goehring, Wexford, PA (US)

(72) Inventor: William R. Goehring, Wexford, PA (US)

( * ) Notice: Subject to any disclaimer, the term of this patent is extended or adjusted under 35 U.S.C. 154(b) by 18 days.

(21) Appl. No.: 14/155,565

(22) Filed: Jan. 15, 2014

(65) Prior Publication Data

US 2014/0124463 A1 May 8, 2014

Related U.S. Application Data

(63) Continuation-in-part of application No. PCT/US2012/046632, filed on Jul. 13, 2012, which is a continuation-in-part of application No. 13/205,874, filed on Aug. 9, 2011, now abandoned, which is a continuation of application No. PCT/US2010/059747, filed on Dec. 9, 2010, said application No. 13/205,874 is a continuation-in-part of application No. 12/238,847, filed on Sep. 26, 2008, now Pat. No. 7,992,726.

(60) Provisional application No. 61/814,907, filed on Apr. 23, 2013, provisional application No. 61/607,052, filed on Mar. 6, 2012, provisional application No. 61/508,200, filed on Jul. 15, 2011, provisional application No. 61/285,082, filed on Dec. 9, 2009, provisional application No. 61/032,673, filed on Feb. 29, 2008, provisional application No. 60/975,632, filed on Sep. 27, 2007.

(51) Int. Cl.
*A47F 1/12* (2006.01)
*A47F 5/00* (2006.01)

(52) U.S. Cl.
CPC . *A47F 1/12* (2013.01); *A47F 1/125* (2013.01); *A47F 5/005* (2013.01)

(58) Field of Classification Search
CPC ..... A47F 1/12; A47F 1/125; A47F 5/005
USPC ..... 211/59.2, 59.3, 184
See application file for complete search history.

(56) References Cited

U.S. PATENT DOCUMENTS 1,702,987 A * 2/1929 Wilson ..... 211/59.3
1,703,987 A 3/1929 Butler (Continued)

FOREIGN PATENT DOCUMENTS

CA 2173009 9/1996
JP 2001017290 1/2001

(Continued)

*Primary Examiner* — Joshua Rodden
(74) *Attorney, Agent, or Firm* — Blynn L. Shideler; Krisanne Shideler; BLK Law Group

(57) ABSTRACT

A manual bottom supporting shelf allocation and management system for allocating shelf space among rows of products and for moving the rows of products toward the shelf front includes a plurality of adjacent shelf allocating and managing units. Each unit includes a base and side divider wherein at least one row of products is positioned on the base adjacent the laterally supporting divider. Each unit is a modular tray which may be, while filled with a row of products, lifted clear of the shelf and moved to another shelf location. A backstop is behind the products so that the products may be manually moved towards the front of the shelf when the backstop is drawn forward while the base remains stationary.

15 Claims, 12 Drawing Sheets

(56) References Cited

U.S. PATENT DOCUMENTS

| | | | | |
|---|---|---|---|---|
| 2,079,754 | A * | 5/1937 | Waxgiser | 211/59.3 |
| 2,098,844 | A | 11/1937 | Waxgiser | |
| 2,652,154 | A | 9/1953 | Stevens | |
| 4,042,096 | A | 8/1977 | Smith | |
| 4,300,693 | A | 11/1981 | Spamer | |
| 4,830,201 | A | 5/1989 | Breslow | |
| 5,123,546 | A | 6/1992 | Crum | |
| 5,160,051 | A | 11/1992 | Bustos | |
| 5,413,229 | A | 5/1995 | Zuberbuhler et al. | |
| 5,458,248 | A | 10/1995 | Alain | |
| 5,542,552 | A | 8/1996 | Yablans et al. | |
| 5,613,621 | A | 3/1997 | Gervasi | |
| 5,624,042 | A | 4/1997 | Flum et al. | |
| 5,634,564 | A | 6/1997 | Spamer et al. | |
| 6,082,556 | A | 7/2000 | Primiano et al. | |
| 6,155,438 | A | 12/2000 | Close | |
| 6,227,386 | B1 | 5/2001 | Close | |
| 6,357,606 | B1 | 3/2002 | Henry | |
| 6,375,015 | B1 * | 4/2002 | Wingate | 211/59.3 |
| 6,719,151 | B2 | 4/2004 | Close | |
| 6,923,330 | B1 | 8/2005 | Nagel | |
| 6,991,116 | B2 | 1/2006 | Johnson et al. | |
| 7,086,541 | B2 | 8/2006 | Robertson | |
| 7,124,897 | B2 | 10/2006 | Bustos | |
| 7,168,579 | B2 | 1/2007 | Richter et al. | |
| 7,395,938 | B2 | 7/2008 | Merit et al. | |
| 7,631,771 | B2 | 12/2009 | Nagel et al. | |
| 7,792,711 | B2 | 9/2010 | Swafford, Jr. et al. | |
| 7,854,333 | B2 | 12/2010 | Kottke et al. | |
| 2004/0178158 | A1 | 9/2004 | Close | |
| 2005/0168345 | A1 * | 8/2005 | Swafford et al. | 340/686.1 |
| 2005/0258113 | A1 * | 11/2005 | Close et al. | 211/59.3 |

FOREIGN PATENT DOCUMENTS

| | | | |
|---|---|---|---|
| WO | WO 03005862 | A2 * | 1/2003 |
| WO | 2006019947 | | 2/2006 |
| WO | 2009042838 | | 4/2009 |

* cited by examiner

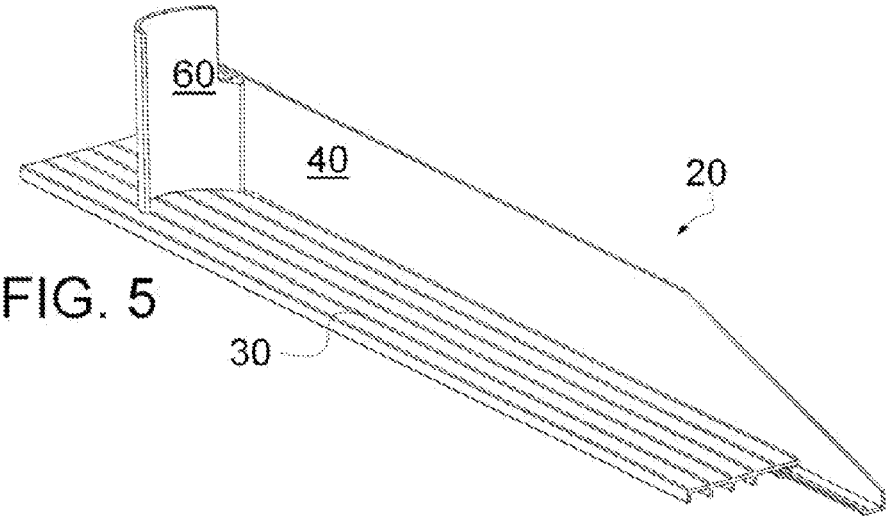
FIG. 5
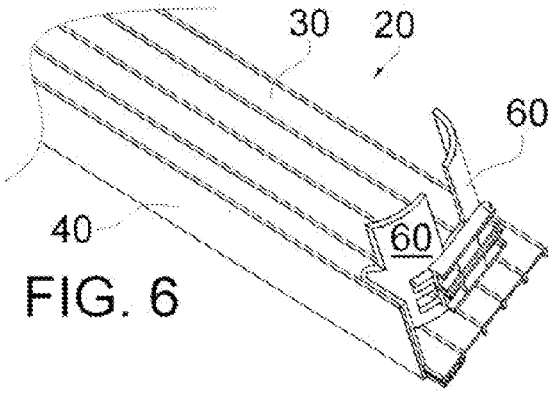
FIG. 6
FIG. 4C
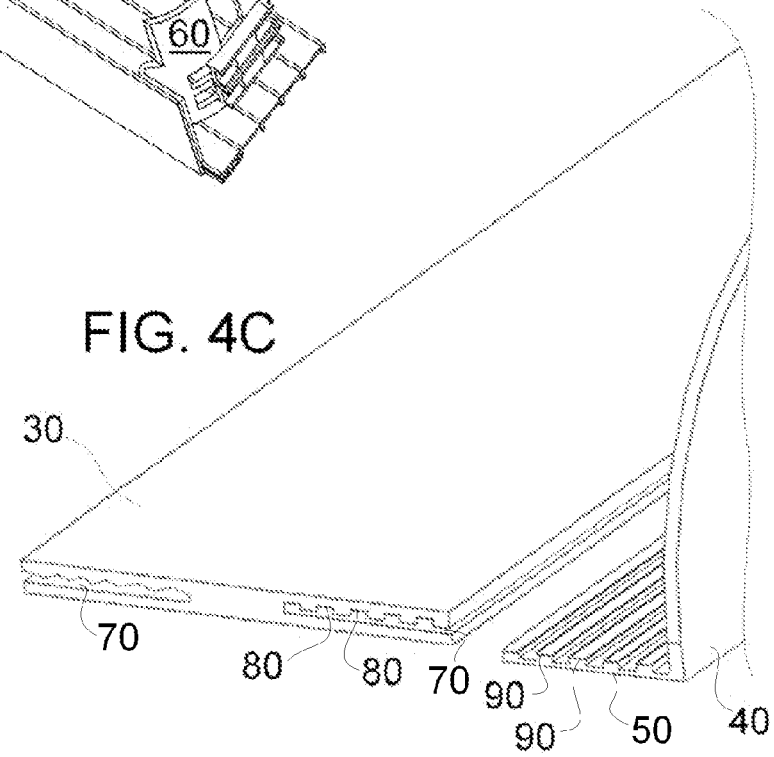

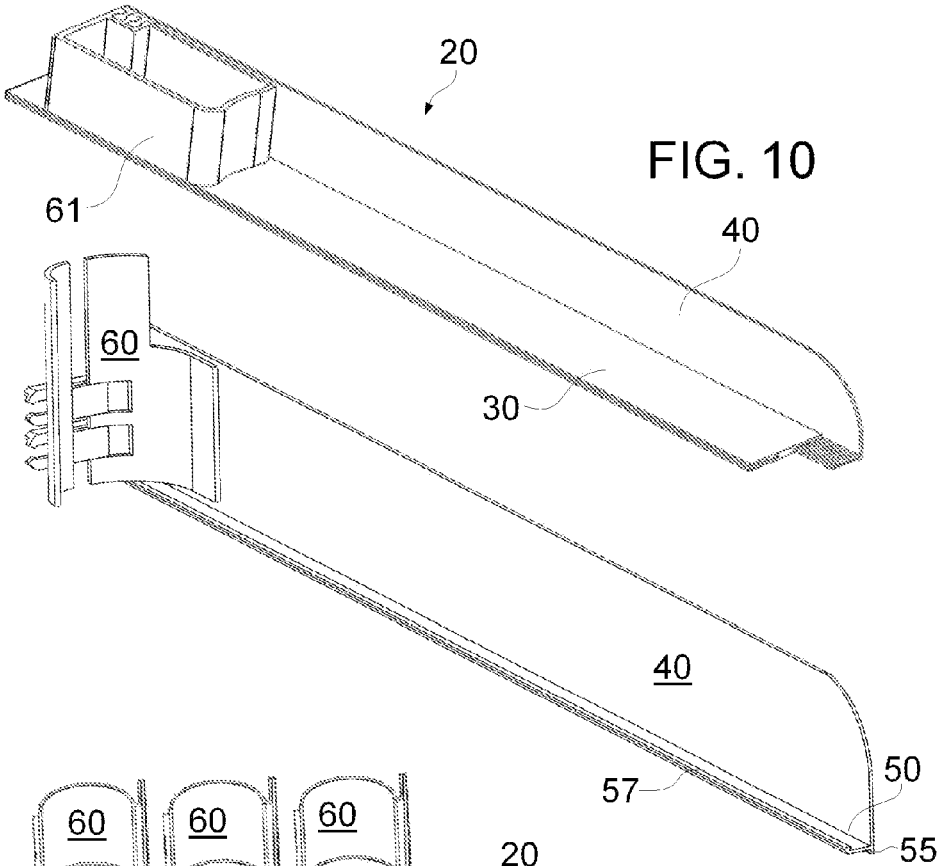
FIG. 10
FIG. 12
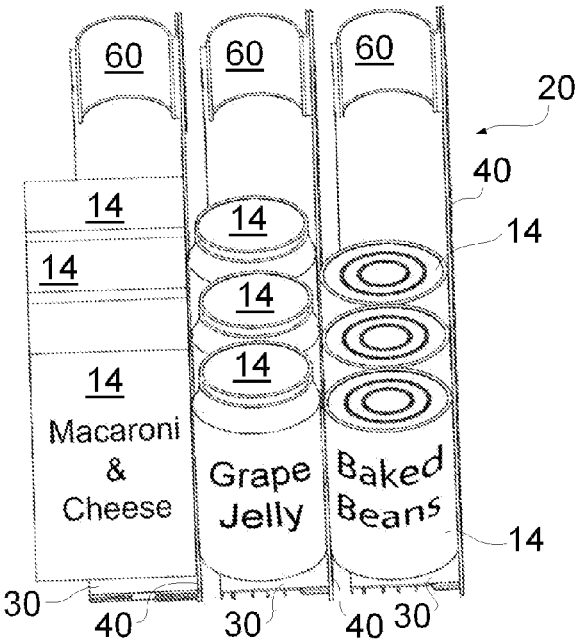
FIG. 11

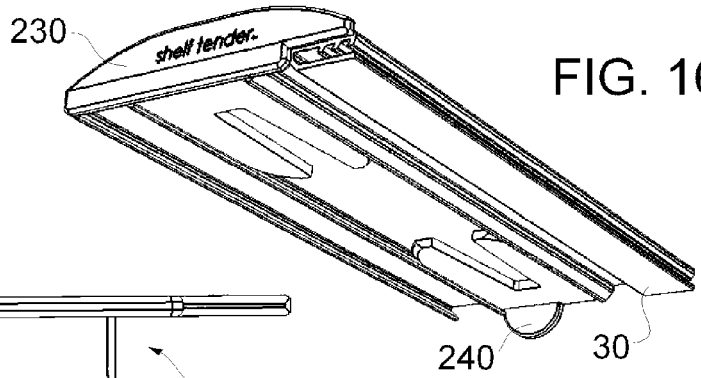
FIG. 16
FIG. 18
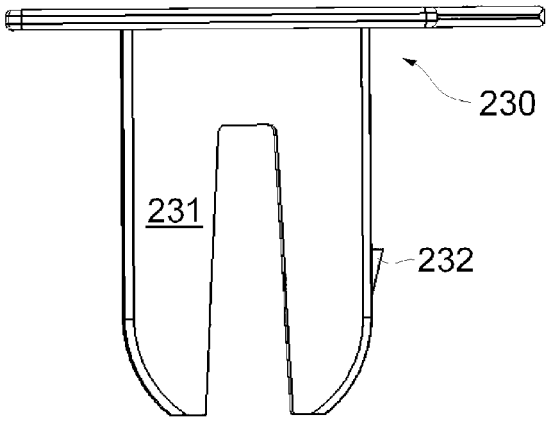
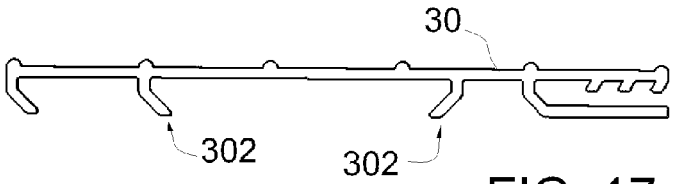
FIG. 17
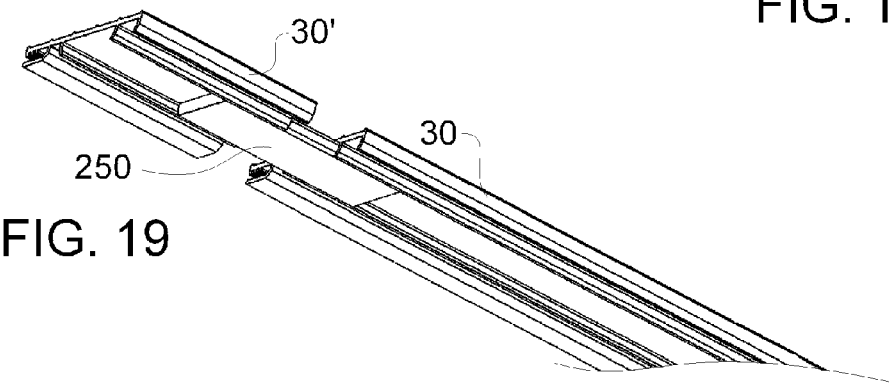
FIG. 19

SPACE SAVING MANUAL SHELF MANAGEMENT SYSTEM

RELATED APPLICATIONS

This application is a continuation in part of International Patent Application Serial Number PCT/US2012/046632 filed Jul. 13, 2012 and entitled "Space Saving Manual Shelf Management System." This application is a continuation in part of U.S. patent application Ser. No. 13/205,874 filed Aug. 9, 2011 entitled "Space Saving Manual Shelf Management System and Shelf Ready Packaging Unit System." This application claims the benefit of U.S. Provisional Application Ser. No. 61/814,907 filed Apr. 23, 2013 entitled "Space Saving Manual Shelf Management System."

International Patent Application Serial Number PCT/US2012/046632 claims the benefit of U.S. Provisional Application Ser. No. 61/508,200 filed Jul. 15, 2011 and U.S. Provisional Application Ser. No. 61/607,052 filed Mar. 6, 2012 both entitled "Space Saving Manual Shelf Management System." International Patent Application Serial Number PCT/US2012/046632 published as Publication Number WO 2013/012709 which is incorporated herein by reference.

U.S. patent application Ser. No. 13/205,874 published as publication number 2012-0204458, which is incorporated herein by reference in its entirety, and is a Continuation of and claims the benefit of PCT Patent Application serial number PCT/US10/59747 filed Dec. 9, 2010 entitled "Space Saving Manual Shelf Management System" which published as International Application under WO 2011/087647. This publication is incorporated herein by reference. PCT Patent Application serial number PCT/US10/59747 claims the benefit of U.S. Provisional patent application Ser. No. 61/285,082 filed Dec. 9, 2009 entitled "Manual Shelf Management System". U.S. patent application Ser. No. 13/205,874 is a Continuation-in-Part (CIP) of and claims the benefit of U.S. patent application Ser. No. 12/238,847 filed Sep. 26, 2008 entitled "Space Saving Manual Shelf Management System" which published as United States Patent Publication number 2009/0084745, now U.S. Pat. No. 7,992,726. This patent and this publication are incorporated herein by reference. U.S. patent application Ser. No. 12/238,847 claims the benefit of U.S. Provisional patent application Ser. No. 60/975,632 filed Sep. 27, 2007 entitled "Manual Shelf Management System." U.S. patent application Ser. No. 12/238,847 claims the benefit of U.S. Provisional patent application Ser. No. 61/032,673 filed Feb. 29, 2008 entitled "Manual Shelf Management System."

BACKGROUND OF THE INVENTION

1. Field of the Invention

The present invention relates to manual shelf management systems, and more specifically to a space saving, manual, modular, containing and laterally supporting, shelf management system.

2. Background Information

In stores, for example grocery stores, that display products for sale on shelves it is necessary to continually replenish products on the shelves so that a constant supply of product is maintained for sale to customers. This replenishment process is called stocking or restocking. Further, it is necessary to continually move the products to the front of the shelf so that customers can more readily see and select those items that they desire in a process called "facing" or "fronting." It is also essential that the products be arranged laterally (side-to-side)

as closely as possible to conserve limited and valuable lateral shelf space and thereby maximize the products that can be properly displayed and sold.

If products are hidden at the rear of the shelf or if an insufficient depth of the shelf is utilized and the product is thereby more readily exhausted, or if the products are in disarray, potential product sales are lost. Stocking new products on store shelves historically requires significant time and effort. Products must be individually positioned on the shelves in straight rows, and sometimes products are stacked one on top of the other adding to the difficulty for the worker. Stocking becomes a taxing exercise in finesse and physical exertion, especially when stocking low or high shelves. The process of "rotation", where older items are brought to the front of the shelf and newer items placed in the rear, historically has required that every item in a product row be individually handled and repositioned when that row is stocked.

Products are occasionally moved to a different location of the store altogether, called "resetting" of the products. Ordinarily all of these so-called "shelf conditioning" tasks described above require the handling of each individual product (e.g. each soup can). This piece-by-piece handling of products is time-consuming, imprecise, creates fatigue for store personnel and impedes the proper completion of some shelf conditioning tasks.

Labor inefficiencies and other problems occur when merchandise is displayed on retail shelves with neither rigid dividers nor an efficient way to bring product forward on the shelf into selling position without handling the merchandise piece-by-piece. These problems pertain to grocery stores and other retail stores where consumer packaged goods, such as food products, spray paint cans and health and beauty care products, are displayed on shelves. With no rigid dividers store personnel must, during product stocking, form rows by reckoning and finesse which is imprecise and time consuming. Further, as new merchandise is fed into rows, packages in the middle of the row tend to move to the left or right (known as "snaking") causing packages in the middle or back of the row to be significantly out of alignment with those packages at the front. This also results in wasted labor as store personnel must handle the merchandise multiple extra times to position products in proper row alignment. Another result is shelf disorganization that degrades the shopping experience by making it difficult for shoppers to locate and reach/grasp merchandise.

Merchandise always is selected by the consumer from the front of the shelf and store personnel are constantly fronting products. The vast majority of store shelves are fronted using the legacy practice of grasping individual packages. This practice is time consuming and can be counter-productive because, as the store clerk reaches with his hand into the shelf to grasp packages; adjacent merchandise is sometimes knocked out of position which requires the clerk to then re-position that disrupted merchandise before the fronting procedure is completed. Further, the piece-by-piece fronting method is ineffective as typically only one or two items may be easily brought forward into selling position leaving merchandise at the middle and rear of the shelf out of shopper view and inaccessible.

The prior art has addressed some of these issues relating to shelf management and developed relatively complex shelf management machines to advance rows of products on a shelf. These shelf management devices are generally complex with multiple parts, are expensive, and involve a complicated installation. Further, some of these prior art devices occupy an objectionable amount of lateral shelf space and thereby do not maximize the amount of lateral shelf space available for display.

U.S. Pat. Nos. 1,703,987; 2,652,154; 4,300,693; 4,830,201; 5,123,546; 5,542,552; 5,634,564; 6,357,606; 7,086,541 and 7,168,579 disclose complex mechanisms for advancing product rows which, in general, provide a spring-biased backstop which constantly and automatically forces the products from the rear toward the front of the shelf. While these so-called "spring-loaded" devices are generally effective for managing light-weight merchandise (e.g. packages of panty hose) they are generally not effective when used for heavier items (e.g. jars of pasta sauce). They are also complex with combined plastic and metal construction and are relatively costly. Additionally, the constantly biased backstop can increase the difficulty of restocking the shelves, as in all of these arrangements the spring-biased backstop must be pushed back with one hand while the new products are positioned on the shelf. Further, the springs can lose their tension over time rendering the system less effective or ineffective.

U.S. Pat. Nos. 5,160,051, 6,082,556 and 7,854,333 disclose shelf management systems that utilize an inclined shelf where products are urged to the front of the shelf by force of gravity. These so-called "gravity fed" systems will not operate with existing flat shelves; rather, the existing shelving is removed and new inclined shelves are installed. A time-consuming and costly installation process is required that involves wholesale removal of existing store shelving and installation of new shelving.

U.S. Pat. No. 6,991,116 discloses a "gravity fed" shelf management system that installs on existing flat supermarket shelving. While effective in merchandising cans, this system is less effective for jars (due to breakage concerns) and will not work for boxes or other non-round packages. It also requires special vertical shelf spacing and may occupy an objectionable amount of lateral space, and thus this system is complex and is relatively expensive.

U.S. Pat. No. 4,042,096 discloses a shelf management system having a "pusher" disposed behind the row of products with side members tying the pusher to a pull handle at the front of the shelf and to confine the row of objects laterally in alignment. A rail is disposed at the front of the shelf to prevent objects from falling off the shelf as the pusher is drawn forward by the handle. A resilient member disposed behind the pusher returns it and the handle to normal position after being drawn forward by a pull on the handle. The system does not present a compact shelf management solution and incorporates a significant number of components including a return spring that is subject to fatigue and failure. The accumulated thicknesses of the side members, which stack laterally against one another, consume too much lateral shelf space along an aisle of these systems and selling space is lost. The system is not adjustable to allow product packages of different widths to be accommodated. The system is not bottom-supporting and does not provide for a modular tray apparatus which allows for easy repositioning of an entire product row and therefore does not allow for rapid product re-setting.

U.S. Pat. No. 2,079,754 discloses a complex arrangement with multiple parts which combines product dispensing with product fronting movement. The side members are arranged in a laterally stacking fashion such that the accumulated thicknesses of the side members combine to consume too much lateral shelf space, wherein selling space on the shelf is thereby lost. Multiple parts of this complex system include a detached "floating" backstop as well as a separate pulling and article receiving component that is manually operated for product movement and dispensing. The system is not bottom-supporting and does not provide a modular tray apparatus that allows for easy repositioning of an entire product row and therefore does not allow for rapid product re-setting.

U.S. Pat. No. 2,098,844 discloses a shelf management system that forms a product supporting tray within which the product can be advanced. This is a complex, multi-piece system that requires installation of components both on the top and on the underside of the shelf such that most standard store shelves would have to be replaced with custom-designed shelves to accommodate this system. Further, because the frame side members laterally stack against one another, the accumulation of the combined side member thicknesses consumes too much lateral shelf area. Similar to the deficiencies with some systems described above, lateral selling space on the shelf is lost. The system does not provide for a modular tray apparatus which allows for easy repositioning of an entire product row and therefore does not allow for rapid product re-setting.

U.S. Pat. No. 6,719,151 and US Published Patent Application Number 2004/0178158 disclose a wire frame shelf management system that provides a manual open bottom shelf management system. The system is designed primarily to fit under the open, concave rounded edges at the base of certain products (e.g. jars of pickles) and fails to provide lateral product support. This lack of lateral support can result in products moving to the left or right or even tipping over during advancement creating significant problems during product movement. In an alternative embodiment wedge-shaped dividers are provided which offer limited lateral support; further, in this alternative embodiment, if the system is filled with products that do not have rounded edges at the base, the wedge-shaped dividers will laterally stack side-to-side causing the accumulated thicknesses of these dividers to consume objectionable lateral selling space. In its preferred embodiment this system fails to provide lateral product support. In a still further embodiment the system employs wedge-shaped dividers that stack side-to-side thereby consuming valuable lateral selling space. The system does not provide for a modular tray apparatus which allows for easy repositioning of an entire product row and therefore does not allow for rapid product re-setting.

U.S. Pat. No. 7,124,897 discloses an assembly deployed on a complex multi-piece platform and features a base divided into rows with dividers. For each row there is a manually-operated pusher mechanism in the form of a rectangular wire device with a front handle and a rear portion that is bent upwards to form a back-stop. The sides of the wire device ride in grooves positioned along either side of the base on which the products rest. This system is complex with both plastic and metal parts and would be relatively costly to produce. Neither the divider spacing nor the width of the fronting mechanism is adjustable; therefore this system cannot be adapted in a retail store to accommodate products that differ in width from those for which the system was originally designed.

U.S. Pat. Nos. 1,702,987; 5,413,229; 6,155,438; 6,227,386; and 6,923,330 disclose a variety of shelf management systems that are representative of the art. None of these systems combine a modular integral tray apparatus that allow for easy repositioning of an entire product row, substantive lateral support of merchandise, dividers that displace minimum lateral shelf space and easily accommodate variable width products.

U.S. Patent Publication No. 2005/0258113 discloses, in one embodiment, a puller member where the puller runs along the side of the product row and is attached to a backstop designed to rest behind the rear-most product in the row. In one embodiment the puller and backstop operates within the confines of a sleeve where the sleeve provides product row separation and provides product lateral support. In one embodiment the sleeve is combined with the puller and backstop and is filled with products to form a shelf ready package. In an additional embodiment the puller and backstop operates between two adjustable side dividers where the dividers provide product row separation and product lateral support. None of the embodiments provide for a combination of a modular integral tray apparatus, substantive lateral support of merchandise, dividers that displace minimum lateral shelf space and easily accommodate variable width products. In none of the embodiments is the side divider integrated with the backstop to form an independent fronting mechanism.

U.S. Pat. No. 6,375,015 discloses a system of product containing trays that are of a fixed, pre-determined width. The trays define the product rows and provide product row separation. The trays can be moved forward to facilitate stocking. In several embodiments an integral spring, which adds cost and increases complexity of the system, is attached to the trays and urges them back to the selling position after stocking. A puller member that is attached to a backstop operates within the individual trays. The puller slides underneath the products and therefore itself provides no product row separation and no product lateral support. The puller and backstop are of a fixed width and are not adjustable to accommodate products of different widths.

U.S. Pat. No. 5,613,621 discloses a system of product row divider panels where a drawbar puller with attached backstop is integral to each divider panel and the drawbar moves in a channel forward and backward along the length of the divider panel. The divider panels are stationary with respect to movement between the front and back of the shelf, although the divider panels can be adjusted laterally to positions relative to adjacent divider panels to fit products of varying widths. The drawbar does not, independent of the divider panel, separate the product rows nor does the drawbar provide lateral support to the products independently of the divider panel. The system operates within a modular frame which obliges the store to adopt the system in increments of more than one product row which reduces its flexibility and requires a time consuming installation process. The system does not provide for a modular tray apparatus that allows for easy repositioning of an entire product row and therefore does not allow for rapid product re-setting.

U.S. Pat. No. 7,395,938 discloses a system of divider panels that slide along a rail affixed to the front shelf edge to accommodate varying width products. In one embodiment, a spring-biased pusher moves along the side divider to urge the displayed products forward. The system does not provide for a modular tray apparatus that allows for easy repositioning of an entire product row and therefore does not allow for rapid product re-setting.

U.S. Pat. No. 7,631,771 discloses a width-adjustable modular tray apparatus with a fronting device integrated into one of two opposing side dividers. The device employs two opposing side dividers, and these dividers stack laterally side-to-side when the tray modules are deployed in a series, and this design consumes more lateral shelf space than does a design where only a single divider is positioned between product rows. This system does not provide for a primary side divider to simultaneously function as a divider and fronting device.

U.S. Pat. No. 5,458,248 discloses in one embodiment a platform upon which multiple rows of products might be positioned and further discloses side dividers that partition the rows of products. None of the embodiments provide for a combination of a modular integral tray apparatus that allows for easy repositioning of an entire single product row, substantive lateral support of merchandise, dividers that displace minimum lateral shelf space and easy width adjustability. In none of the embodiments is the side divider integrated with the backstop to form an independent fronting mechanism.

U.S. Pat. No. 7,792,711 discloses an apparatus for electronically tracking the position of products on a retail shelf for the purpose of assisting with product ordering and alerting the store to possible theft. In the preferred embodiments, the fronting mechanism that is integrated with the electronic tracking device is a spring-biased pusher and is not manually operated. No modular tray device that allows for easy repositioning of an entire single product row is contemplated.

The above identified patents and patent publications are representative of the art and these references are incorporated herein by reference in their entirety. It is the object of the present invention to address the deficiencies of the prior art shelf management systems and provide a highly effective, very low-cost, easy to install and easy to use shelf management system.

SUMMARY OF THE INVENTION

One aspect of the present invention provides a manual, bottom supporting and side containing, shelf allocation and management system for allocating shelf space among rows of products and for moving the rows of products toward the front of the shelf. The system comprises a plurality of adjacent shelf allocating and managing units, each unit associated with at least one, and preferably one, row of products and freely moveable as a unit relative to the shelf. Each shelf allocating and managing unit is comprised of a product supporting base coupled with a side divider that is connected to the base in a fixed width position, or alternately in a variety of width positions. The side divider and base are configured to move relative to one another in a direction parallel to their length. At least one row of products associated with the unit may be positioned on the shelf on top of the base and immediately adjacent the side divider. The shelf allocating and managing unit supports the products on the base in at least one, and preferably one product row, so that the product row may be easily moved when the unit is moved or lifted, and the units combine to provide substantive lateral support on both sides of the products at least when a side divider of the subject unit is associated with a side divider of an immediately adjacent unit. Each shelf allocating and managing unit includes a backstop protruding substantially perpendicularly from the rear of the side divider and substantially across the surface of the base and behind the at least one row of products associated with the unit where, when the side divider is slideably moved forward relative to the base, the backstop may be engaged with the products and may urge them forward in a direction extending between the front and the back of the shelf and parallel to the length of the base and substantially perpendicular to the lateral length of the shelf.

A further embodiment of the invention provides a bottom supporting shelf allocating and management system for allocating shelf space among rows of products. The system comprises a plurality of adjacent shelf allocating and managing units, each unit associated with at least one row of products, wherein each unit includes: a base adapted to rest on the shelf and to support the at least one row of products, a single side divider removeably attached to the base and extending upward from a side edge of the base wherein the at least one row of products associated with the unit may be positioned on the base immediately adjacent the side divider, a backstop attached to a rear inside of the side divider and extending across the base and configured to push products forward along the base, a sensor configured for detecting the number of products on the base; and a transmitter for selectively transmitting the sensed number of products on the base.

A further embodiment of the invention provides a bottom supporting shelf allocating and management system for allocating shelf space among rows of products. The system comprises a plurality of adjacent shelf allocating and managing units, each unit associated with at least one row of products, wherein each unit includes: a base adapted to rest on the shelf and to support the at least one row of products, a single side divider removeably attached to the base and extending upward from a side edge of the base wherein the at least one row of products associated with the unit may be positioned on the base immediately adjacent the side divider, where the base and side divider are joined as an integral unit so they cannot move relative to one another, a backstop extending across the base and configured to push products forward along the base, a puller coupled to the backstop, where the puller is situated within a channel in the surface of the base whereby the products may be urged forward by actuating the puller.

These and other advantages of the present invention will be clarified in the description of the preferred embodiments.

BRIEF DESCRIPTION OF THE DRAWINGS

FIG. 4C is an exploded perspective view of an optional embodiment of a shelf allocating and managing unit according to another embodiment of the present invention with a coupling mechanism that allows the unit to be adjusted to various widths;

FIG. 5 is a perspective view of a single shelf allocating and management unit of the shelf allocating and managing system of the present invention;

FIG. 6 is a rear perspective view of a single shelf allocating and management unit of the shelf allocating and managing system according to the present invention showing the backstop attached to the side divider;

FIG. 10 is a perspective view of an optional elongated backstop adapted to shorten the depth of the product row according to another embodiment of the present invention;

FIG. 11 is a perspective view showing products merchandised on threeside-by-side shelf allocating and managing units configured so that one side of the products hangs off the side edge of each unit assuring that the only distance between adjacent product rows is the thickness of the divider;

FIG. 12 is a perspective view of a divider uncoupled from a shelf allocating and managing unit;

FIG. 16 is a perspective view of the underside of a base of a shelf allocation and management unit showing how both the face plate and rear catch are inserted into and are attached to features on the underside of the base;

FIG. 17 is an elevation end view of one embodiment of the base showing the configuration of the two cupped legs that together present a receiving channel for parts inserted into either end of the base;

FIG. 18 is a top plan view of a face plate with integral male insertion piece featuring a pant leg design and locking barb according to the invention;

FIG. 19 is a bottom perspective view of one aspect of the present invention showing a connector piece configured to attach two sections of base of a shelf allocation and management unit enabling the base to be lengthened or shortened;

DESCRIPTION OF THE PREFERRED EMBODIMENTS

Figure 1:
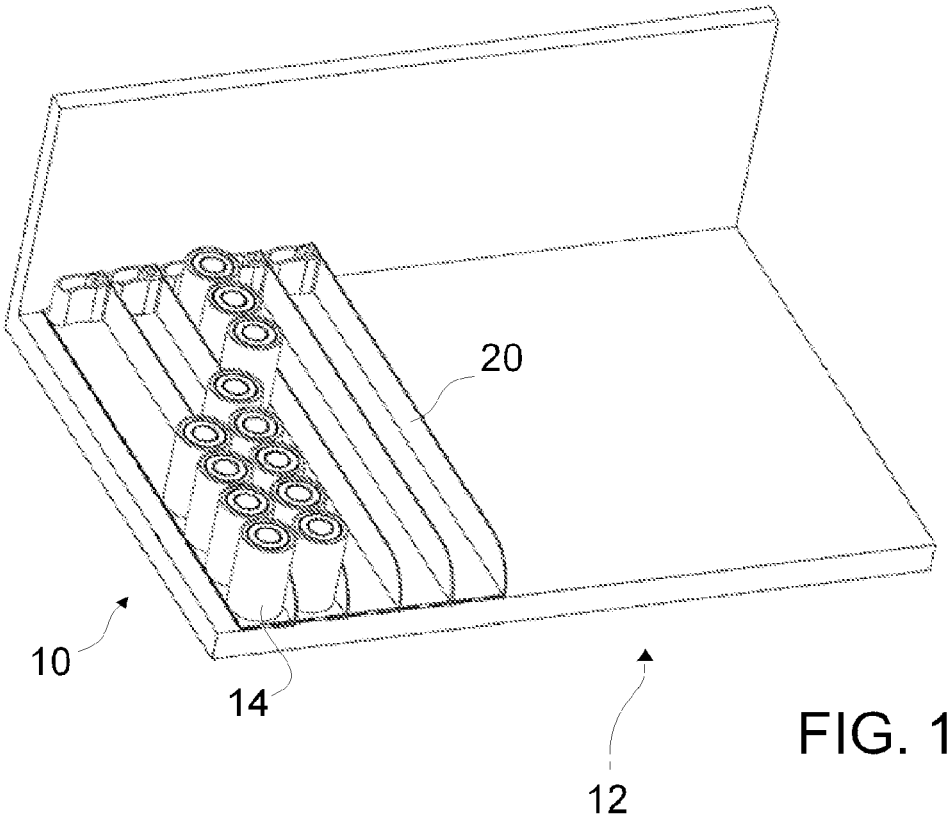
FIG. 1 is a schematic perspective view of the shelf allocation and management system according to one embodiment of the present invention.

It is noted that, as used in this specification and the appended claims, the singular forms "a," "an," and "the" include plural referents unless expressly and unequivocally limited to one referent. For the purposes of this specification, unless otherwise indicated, all numbers expressing parameters used in the specification and claims are to be understood as being modified in all instances by the term "about." The terms "about" or "approximate" or similar terms within this application will generally mean within 10% unless otherwise noted. Accordingly, unless indicated to the contrary, the numerical parameters set forth in the following specification and attached claims are approximations that may vary depending upon the desired properties sought to be obtained by the present invention. The various embodiments and examples of the present invention as presented herein are understood to be illustrative of the present invention and not restrictive thereof and are non-limiting with respect to the scope of the invention.

The present invention provides a manual, modular, bottom supporting and side containing, shelf allocation and management system 10 for allocating shelf space along a conventional retail store shelf 12 among rows of products 14; for moving the rows of products 14 or individual products 14 from the rear or back of the shelf 12 toward the front edge of the shelf 12; and for re-setting of the rows of products 14 to alternate positions in the store. The direction of movement is standard in shelf management systems and is generally in line with the depth of and perpendicular to the lateral length of the shelf 12. The system 10 comprises a plurality of adjacent shelf allocating and managing units 20, each unit 20 associated with at least one row of products 14 and freely moveable as a unit relative to the shelf. The term manual within this application and in connection with the system 10 references that only manual movement is used in the system, as opposed to spring assisted systems or gravity assisted systems. As further described below, aspects of the present invention can be used in non-manual systems.

The system 10 includes a plurality of adjacent shelf allocating and managing units (also called managing units) 20 best shown in FIGS. 1, 2A, 2B, 3A 5 and 11. Each managing unit 20 will be a multiple piece managing unit 20 the pieces of which can be formed easily as via plastic extrusion or injection molding. It will be desirable for the managing unit 20 to be formed as an assembly for the purpose of allowing fronting operation and making the managing unit 20 adjustable in some embodiments.

Each managing unit 20 includes a base 30 coupled to a side divider 40. Each unit 20 is positioned along the depth of the shelf 12 generally extending the full effective front-to-back depth of the shelf 12 so as to maximize usable shelf space. The lengths of the base 30 and side divider 40 may be roughly equivalent. Lengths of 10"-40" for units 20 are possible, with 14"-26" lengths for unit 20 covering the vast majority of retail shelving 12.

The base 30 lays flat on the shelf 12 which is to say that the base 30 rests on its broad bottom surface and the base 30 supports at least one row of products 14 positioned front-to-back. The products 14 rest on the top surface of the base 30, and the products 14 may be single-high or may be stacked 2-high, 3-high or more than 3-high. The base 30 rests on the shelf 12 surface but is not attached to the shelf 12 with adhesives or fasteners. This enables the base 30 to freely slide along the shelf 12 surface to the left or to the right, which facilitates adding and removing product rows, allows side-by-side units to freely "seat" laterally with one another during installation, and also allows the unit 20 to be slid outward and removed from the shelf altogether as would be useful when products are re-positioned in the store.

As shown in FIG. 11, the width of the base 30 roughly corresponds to, yet preferably is somewhat narrower than, the width of the products 14 (e.g. 3.00"), and the height or thickness of the base 30 should be as small as possible while allowing for features to be incorporated into the base 30 enabling coupling of the side divider 40 to the base 30 and to allow for structural integrity of the unit 20. The height or thickness of the base 30 may range from approximately 0.20" to 0.50".

As shown in FIGS. 4-A and 4-B, the side divider 40 is one solid piece and features an integral connecting tab 50 that runs generally the full length of the divider 40 and is oriented at a 90-degree angle to the divider 40. When viewed in cross section the side divider 40 with connecting tab 50 resembles the capital letter "L" or a capital letter "L" facing backwards. When the side divider 40 is coupled to base 30 side divider 40 protrudes vertically and perpendicular from the base 30 and shelf 12. The thickness of the side divider 40 should be as small as possible while still providing structural integrity for the side divider 40. It is preferred that the thickness of the side divider 40 be at a minimum, for example 0.045", so that the least possible amount of valuable lateral shelf space is occupied by side divider 40 between rows of products 14. The height of side divider 40 should be sufficient to provide lateral support on one side of the products 14 associated with the unit 20 and should generally correspond to the height of the products 14 or stack of products 14 and may range from approximately 1.00" to approximately 12.00", with 3.00" being a typical height. As shown in FIG. 4-B, the width of the connecting tab 50 shall generally be sufficient to allow for positive coupling to the female channel 70 on the side edge of base 30 and will typically be approximately 0.75".

Figure 3A:
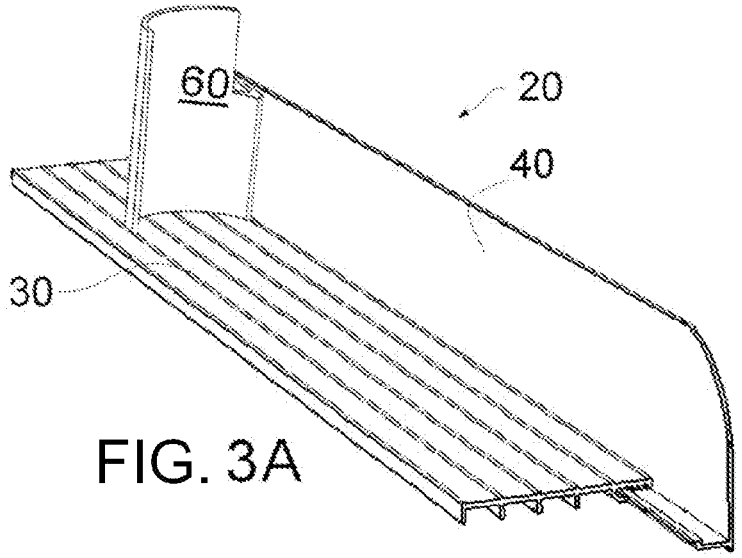
FIG. 3A is a perspective view of a single shelf allocating and managing unit of a shelf allocating and managing system according to one embodiment of the present invention.
Figure 3B:
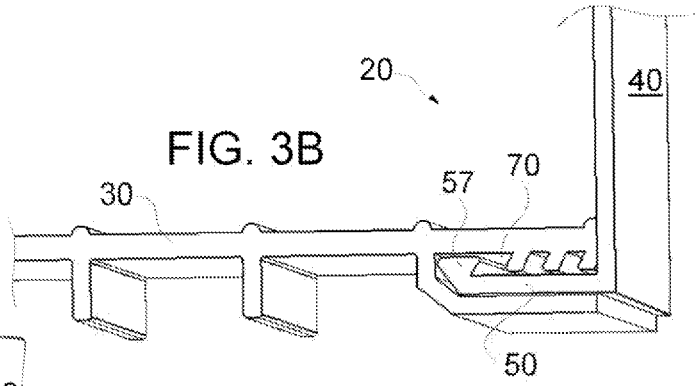
FIG. 3B is an enlarged perspective view of a portion of the single shelf allocating and managing unit of FIG. 3A showing one embodiment of a coupling mechanism between a base and a side divider thereof.
Figure 4A:
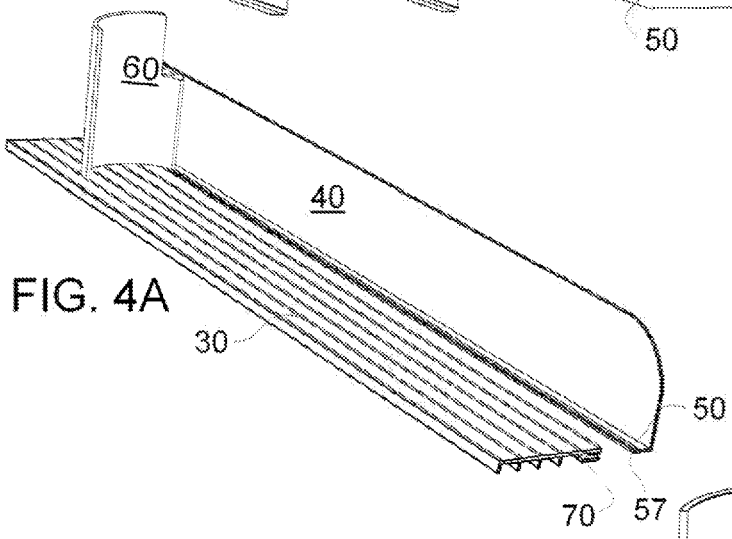
FIG. 4A is an exploded perspective view of the shelf allocating and managing unit of FIG. 3A showing the base uncoupled from the side divider.
Figure 4B:
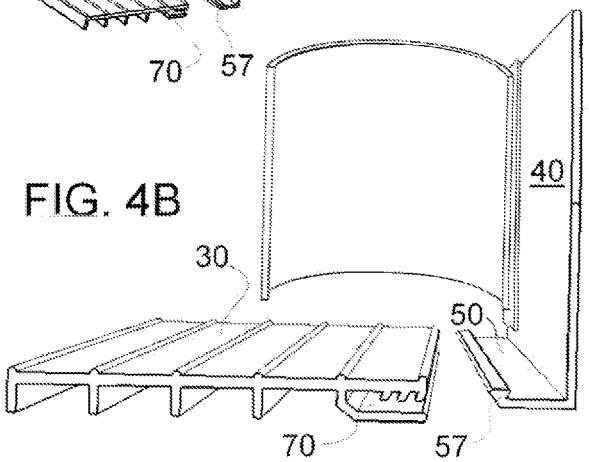
FIG. 4B is an enlarged exploded perspective view of the shelf allocating and managing unit of FIG. 4A.

As shown in FIGS. 3B, 4A and 4B, running along and parallel to the length of the base 30, on either the left or the right side edge of the base 30, is a female opening or channel 70. In some embodiments a unit 20 will feature a channel 70 on both the left and right side edges. This channel 70 is a void that is generally the female mirror opposite of the male connecting tab 50 which protrudes from the side divider 40. The channel 70 is designed to receive the connecting tab 50 of the side divider 40 so that the base 30 and side divider 40 may be coupled together.

As shown in FIGS. 3B and 4B, the connecting tab 50 features a catch or barb 57 that allows the tab 50 to slide into (and out of) channel 70 from either the front or back of base 30 yet prevents the tab 50, once coupled to base 30, from pulling out and away in a lateral direction from the base 30. The channel 70 on base 30 is in a shape that is effectively the mirror opposite of tab 50 and catch 57 so that the connecting tab 50 dovetails with channel 70. The channel 70 as shown includes a plurality of downward projections to create an end space to receive and laterally engage the catch 57. The channel 70 could be formed as a mirror image of the tab 50, however the use of a plurality of same thickness projections in channel 70 as shown is believed to be preferred from an extrusion or molding standpoint without detrimentally effecting the operation of the channel 70. When tab 50 is inserted into channel 70 there is not a tight fit but rather there is some "play" which allows movement of tab 50 both forward and backward within the channel 70. Side divider 40 and base 30, once coupled together, are locked in a fixed lateral position yet side divider 40 is enabled to slide freely forward and backward in a direction parallel to the length of the base 30 while the base 30 remains stationary.

The connecting tab 50 is inserted into the female channel 70 on whichever side of the base 30 that the female channel 70 is positioned. The insertion point of connecting tab 50 into female channel 70 shall be preferably from either the front end or rear end of the base 30 and not the side of base 30. In some embodiments, it may be desirable for the connecting tab 50 to be inserted into the female channel 70 from the side of the base 30.

Once the connecting tab 50 is inserted into the female channel 70 of the base 30 the side divider 40 is then slid into position so that the front end of the side divider 40 lines up with the front end of the base 30. Once the base 30 and side divider 40 are coupled together in this manner, the unit 20 is positioned on the shelf 12 so that the front of the unit 20 is positioned at the front edge of the shelf 12 and the rear of the unit 20 is positioned at the rear of the shelf 12.

In a further embodiment female channel 70 will be deeper (wider) and connecting tab 50 will likewise be wider and both will be configured, possibly with mating ridges 90 and corresponding grooves 80 as shown in FIG. 4C, to allow channel 70 and connecting tab 50 to be coupled together in multiple width positions so that, when coupled to base 30, side divider 40 may be positioned at various distances from the lateral center of base 30 thereby allowing for the unit 20 to be adjusted to various width settings. In this embodiment, the unit 20 might be adjusted to, for example, three different width settings so that products of different widths might be merchandised. Once the base 30 and divider 40 are coupled to achieve a certain width setting, the divider 40 could slide freely forward and backwards relative to the base 30 in a manner identical to the non-width-adjustable embodiment.

In the embodiment of unit 20 where the divider 40 and base 30 may be coupled in a fixed width setting, products 14 of different widths could be accommodated by selecting from a variety of different base 30 widths rather than by selecting from among a variety of multiple available coupling width positions for the unit 20. Further, as described below, a fixed-width unit 20 may fit a variety of product 14 widths.

As shown in FIGS. 5, 6 and 11 a backstop 60 is attached to the rearward end of the inside surface of side divider 40. When side divider 40 and base 30 are coupled together to form a unit 20 the backstop 60 protrudes laterally in a direction substantially across the surface of base 30. In the case, for example, where the side divider 40 is coupled to the right side of the base 30, the backstop 60 shall protrude from the side divider 40 and to the left. The purpose of backstop 60 is twofold. First, the backstop 60 shall allow products 14 associated with unit 20 to be moved forward when the side divider 40 is drawn forward while the base 30 remains stationary; second the backstop 60 shall prevent the products 14 from sliding off of the back end of the unit 20 in the case, for example, when the entire unit 20 is lifted, while full of products 14, and moved to another shelf 12 location as in the case of re-setting of the products 14.

The backstop 60 may be of variable lengths and heights and will generally correspond to the vertical and horizontal dimensions of the products 14 or product 14 stack so that, if the backstop 60 were to be drawn forward along with side divider 40, the backstop 60 will make sufficient contact along the width and height of the product 14 in the associated row that the products 14 will be urged forward. Similarly, a backstop 60 of appropriate size may be selected so that the products 14 in the associated row, at least in cases where they are merchandised single-high, shall be prevented from sliding off of the rear end of the base such as in those cases where the entire unit 20, when filled with products 14, is lifted clear of the shelf 12 and positioned at another shelf 12 location as in the case of re-setting. In the case where products 14 are stacked 2- and 3-high a taller backstop 60 may be used so that stacked products 14 are prevented from falling behind backstop 60. It may be desirable to position the backstop 60 on the divider 40 such that the bottom of backstop 60 is spaced slightly above the base 30 to prevent the backstop 60 from an unintended engaging of the rear end of the base 30, as a small gap between the bottom of the backstop 60 and the base will not detrimentally effect operation of the system.

In a further embodiment as shown in FIG. 10, a backstop depth extender 61 may be removably attached to backstop 60 where the backstop depth extender 61 extends forward of the rear end of side divider 40 along the depth of base 30 and towards the front of the base 30. The backstop depth extender 61 can also be formed as an unattached filler block that is the shape of one or some other multiple of products (or stacked products). The backstop depth extender 61 may be of various lengths so that the forward end of the backstop depth extender 61 may be positioned at various distances forward of the rear terminus of side divider 40 in order to shorten the effective depth of the row on unit 20 as may be desirable in cases where a product 14 is a slow seller and store management does not want excessive inventory of product 14 to be stocked needlessly on the shelf 12.

Backstop 60 may be, along the lateral dimension, curved in a concave fashion so as to be sympathetic to and to receive the generally round shape of the products 14. This concave curve would allow for more thorough contact of the backstop 60 with the products 14 when the side divider 40 is drawn forward with the effect that backstop 60 is less apt to bend backwards and otherwise deform undesirably in response to the weight/inertia of the products 14.

As shown in FIG. 6, the backstop 60 may be permanently attached to side divider 40 such as by glue, adhesive tape, or by ultrasonic welding or other known techniques. In another embodiment, backstops 60 of various widths and/or heights could be removably attached to side divider 40 by employing, for example, a receiving shoe permanently attached to side divider 40 to which a variety of different backstop 60 sizes could be removeably attached by friction slip fit. Backstop 60 may be attached to divider 40 such that the connection is made behind, rather than forward of, the backstop so that no lateral space is occupied at the point of connection.

As described above, as shown in FIGS. 3A, 3B and 5, the connecting tab 50 of the side divider 40 may be inserted into the female channel 70 on the side edge of the base 30 in such a manner that, while the base 30 and connecting tab 50 (and hence side divider 40) are secured in lateral position, the connecting tab 50 shall slide freely and with little resistance both forward and backward, parallel to the length of the base 30, within the female channel 70. The front of side divider 40 may be easily grasped with thumb and forefinger by an operator and drawn forward while the base 30 remains stationary. With the side divider 40 free to move forward and backward in this fashion, backstop 60 attached to the inside surface of the rear of side divider 40 would, when the side divider 40 is drawn forward while the base 30 remains stationary, travel forward above and along the surface of base 30 and make contact with and engage the rearmost product 14 in the product 14 row which will thereby be urged forward, and the rearmost product 14 will then make contact with the product 14 immediately in front of it and that product 14 will be urged forward, and other products 14 in the row will in turn be urged forward in the same fashion until all products 14 in the product row have been moved as far forward towards the front shelf edge as is desired. Once the desired position of the products 14 is achieved within the unit 20 the side divider 40 shall be slid back (rearward) to the starting position where the front of the side divider 40 shall be more or less in line with the front of the base 30.

The system 10 described above generally in connection with FIGS. 1-14A discloses an effective shelf management system for use on retail store shelves, especially on grocery store shelves, as the system 10 described above provides effective row separation, provides lateral support for product rows and allows for easy and rapid row fronting. Further, the system 10 described above maintains straight product rows thereby creating positive row segregation which enhances the shopping experience by facilitating product identification and access. Further, the positive row separation prevents co-mingling of products on the shelves (where an item that is supposed to be in one row inadvertently moves into a different adjacent row) which causes extra work for store clerks, leads to difficulty in determining how much of a given item is stocked on the shelf, and can lead to items becoming "lost" on the shelf such that they do not sell before their expiration date. The system 10 described above does not attach to the shelf with mechanical fasteners or adhesives making installation fast and easy. Further, because this system is not attached to the shelf, new product cut-ins and merchandise reconfigurations (called re-sets) are easy to accomplish. As the system 10 does not attach to the shelf and is comprised of a individual trays that support individual product rows, merchandise re-sets are made easier as the units of this system, while loaded with merchandise, can be lifted off and away from the shelf and repositioned on a different shelf location in the store. Further the system 10 described above is an easy to manufacture and a low cost system which is a crucial feature for display systems which stores find unattractive if the systems are expensive.

The system 10 discussed above and disclosed generally in FIGS. 1-14A has, however, several limitations. First, if products are fronted too vigorously the merchandise in the product row may inadvertently travel off the front end of the unit and fall onto the floor. A second limitation is that a face plate attached to the front of the base of the unit may be too small as a location for placement of identifying information so that, if the store, for example, wanted to place the name of a merchandise brand on the face plate, the lettering would be too small to be readily visible. A further limitation of the above described system is that the bases of the units in the system tend to move forward objectionably when the divider of the unit is pulled forward as during product fronting. When the bases move forward store personnel must then take time to push the unit back onto the shelf into correct position. As the principal purpose of the system 10 is to decrease labor at the shelf, any extra tasks presented in the operation of the system itself should be minimized or eliminated.

Modifications of the system 10 are described in connection with FIGS. 14B-25 that address many of these perceived limitations further improving the system 10 of the present invention.

Figure 8A:
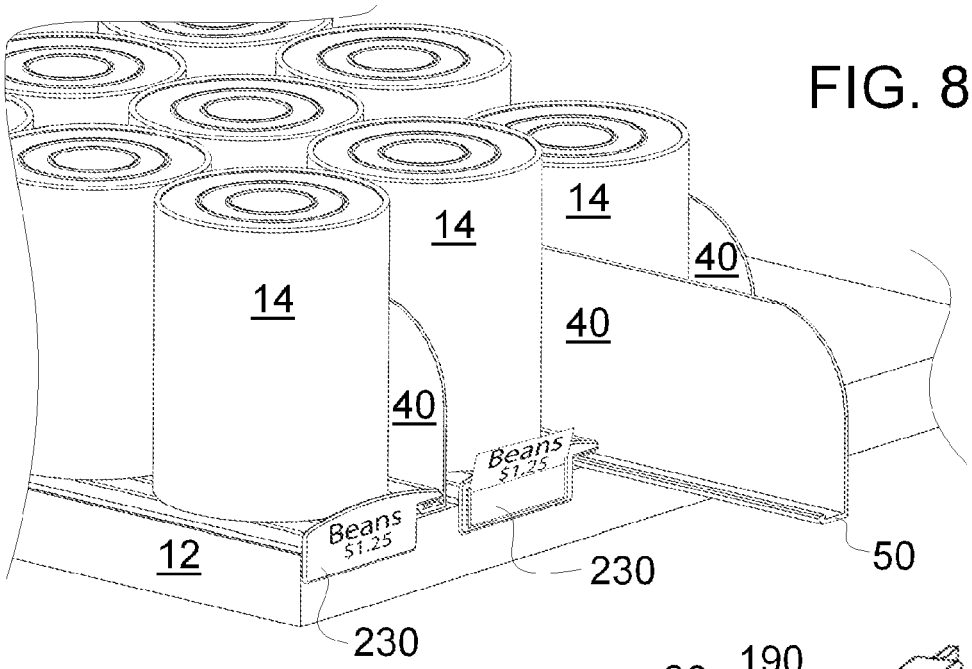
FIGS. 8A and B are perspective views of a portion of further embodiments of the present invention where the shelf allocating and managing unit is adapted to receive product label information attached to the front of the unit.
Figure 14B:
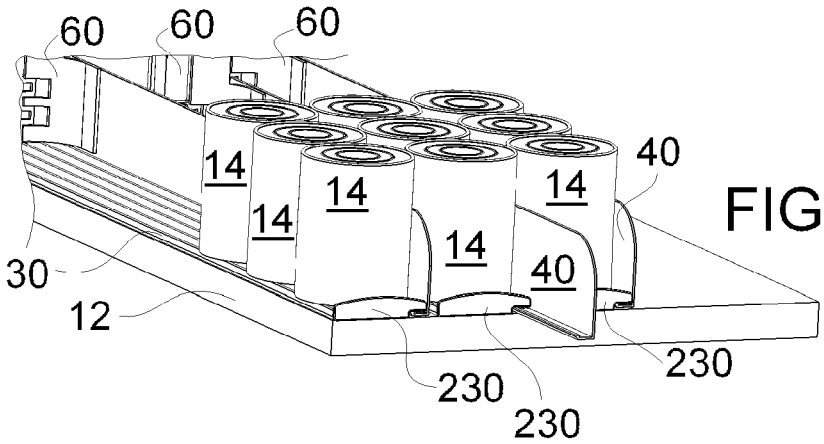

The system 10 as shown in FIGS. 8A, 14B, and 16 provides a face plate 230 that is attached to the front end of the base 30 of the unit 20. The face plate 230 is a piece of plastic or other material, that, once attached to the base 30, extends vertically above the top surface of the base 30 and is oriented perpendicular to the top surface of the base 30 so that it may give the appearance of an end-cap. The face plate 230, in the lateral dimension, corresponds to the width of the base 30 and, in the vertical dimension, begins at a point approximately at bottom of the base 30 and extends upward to a point approximately 0.30" above the top surface of the base 30. The face plate 230 may extend anywhere from 0.10" to 6.00" above the top surface of the base 30 although, for most applications, the face plate 230 will extend above the top surface of base 30 between 0.20" and 0.50".

Figures 7A, 7B, 8B:
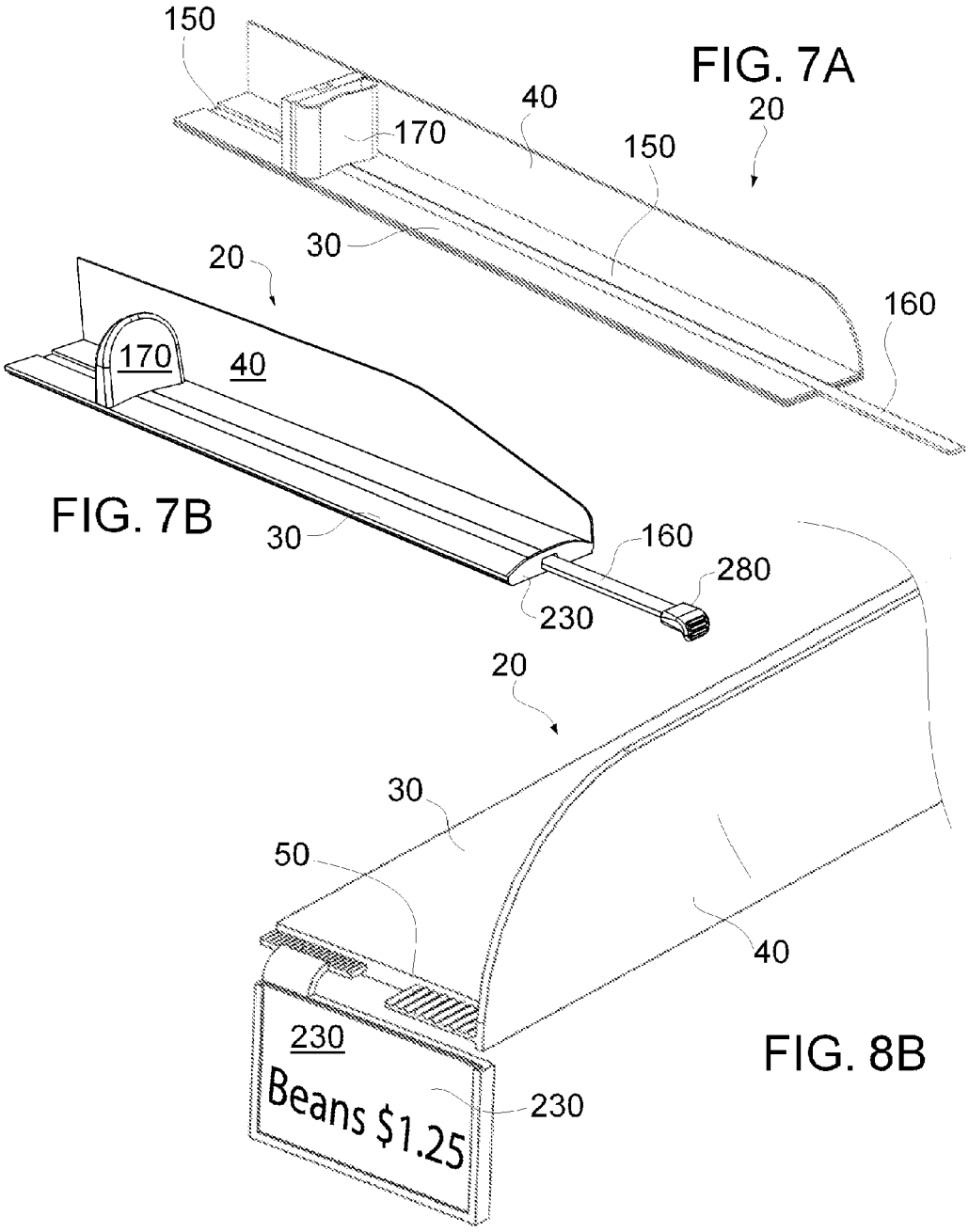
FIGS. 7A and B are perspective views of further embodiments of the present invention where the unit is configured to receive a puller and backstop assembly in a channel positioned in the lateral center of the top surface of and along the entire length of the base of the unit.

The face plate 230 serves to enhance the aesthetics of the front of the units 20 which is important as maintaining an attractive appearance of store shelves 12—and especially the front of the shelves 12—is a high priority for store management. Further, as shown in FIGS. 8A and 8B, the face plate 230 serves as a location for product identifying information (for example, brand information) in a position directly in front of the merchandise 14 row. Further, the face plate 230 serves as a fence or stop which prevents merchandise from falling off of the front of the unit 20 when the fronting mechanism is actuated, and this eliminates the need of the clerk to use a second hand as a stop to keep the items 14 from falling. As the face plate 230 is approximately 0.30" high it is high enough to serve as a product stop for most consumer packages yet is low enough that merchandise 14 selected for purchase can easily be lifted above the face plate 230 and removed. Further, the face plate 230 is not so high as to obstruct the view of the bottom of merchandise 14 packages where key information for products 14 is sometimes printed.

In order to reduce the height of the face plate 230, and therefore the (albeit small) visual and mechanical obstruction presented by it, the top of face plate 230 may be made of a high-friction, perhaps rubberized, material. This high-friction material would act as a friction stop "grabbing" the bottom of the product-14 packages and preventing them from inadvertently falling off the front of unit 20 achieving the same arresting effect as the higher face plate 230 described above. This face plate 230 with high friction material may only need to be as high as, for example, 0.100" or perhaps one-third as high as the conventional face plate 230.

Figure 15:
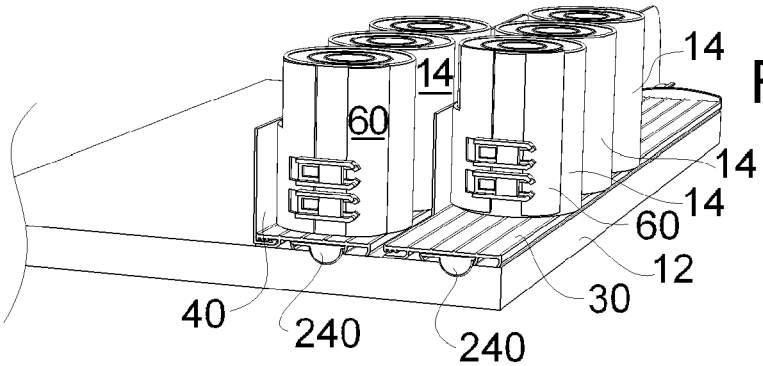
FIG. 15 is a perspective view of the rear of several units of a shelf allocation and management system according to one embodiment of the invention showing a rear catch seated against the back edge of a retail store shelf.

A further aspect of the present invention as shown in FIGS. 15 and 16 provides a rear catch 240 the purpose of which is to make positive arresting contact with the rear edge of the shelf 12. The rear catch 240 may take the form of a piece of plastic or other material that attaches to the rear end of the base 30 and protrudes downward approximately 0.50" at more or less a 90-degree angle in relation to the plane of the base 30 surface. The rear catch 240 may extend downward below the bottom of the base 30 from 0.10" to 2.00" with 0.50" being a typical extension length. The extension length of rear catch 240 should be long enough to provide significant arresting contact with the rear edge of the shelf 12 but short enough so that the unit 20 may be lifted up and away from the shelf 12 without undue effort. The rear catch 240 hangs off of the end of the back of a store shelf 12, and, when the shelf management units 20 are placed on the shelf 12 during installation, the unit bases 30 are positioned so that the rear catch 240 is seated against the rear shelf 12 edge such that the bases 30, when installed in a series side-to-side, are maintained in alignment with respect to the rear edge of the shelf 12, and, therefore, are maintained in alignment with the front edge of the shelf 12. In addition to maintaining the shelf management units 20 in proper alignment, the rear catch 240 prevents the units 20 from moving forward when the divider 40 is pulled forward to actuate the fronting mechanism. If the units 20 in a system 10 move inadvertently forward during row fronting then the store clerks must take extra time to re-position the units 20, which is wasted time. A further advantage of the rear catch 240 preventing unwanted forward movement of the units 20 during row fronting, is that store clerks need not use their free hand to hold the base 30 steady when pulling the divider 40 forward. This frees up the clerk's second hand so that an adjacent shelf management unit 20 may be fronted enabling two units 20 to be fronted simultaneously.

When units 20 in the system 10 are outfitted with both face plate 230 and rear catch 240, store clerks, while actuating the fronting mechanism of a unit 20, no longer need to use a second hand to prevent products 14 from falling off the front of the unit 20 nor do they need to use a second hand to maintain the base 30 in proper position. This allows store clerks to front one row with one hand and an adjacent row with a second hand so two rows may be fronted simultaneously, and this doubles the fronting speed and effectiveness of the system 10. The system without the face plate 230 and rear catch 240 allowed an approximate 50% reduction in fronting time. By enabling two-at-a-time row fronting the addition of the rear catch 240 and face plate 230 should allow a reduction in fronting time on the order of 70% or greater.

Figure 2A:
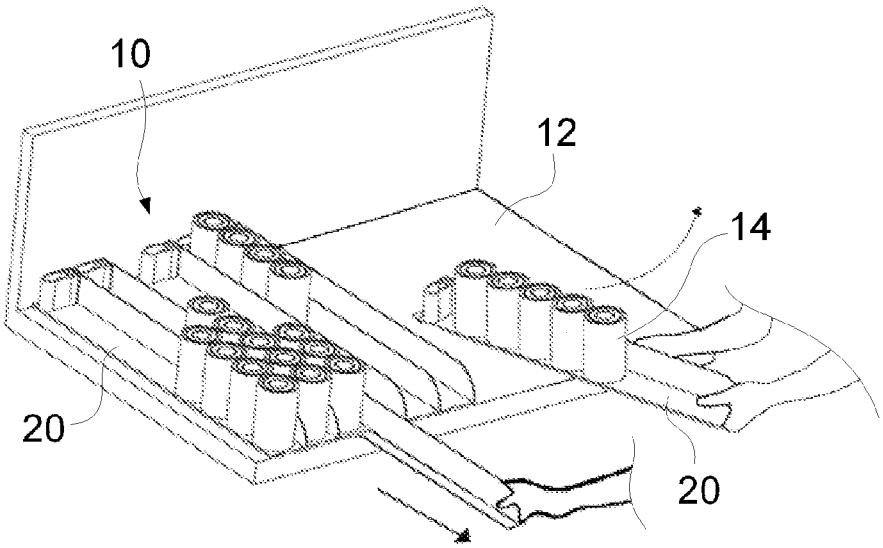
FIG. 2A is a schematic perspective view of the shelf allocation and management system of FIG. 1 showing manual fronting operation of the system and showing the modular nature of the system and a resetting operation using the system.
Figure 2B:
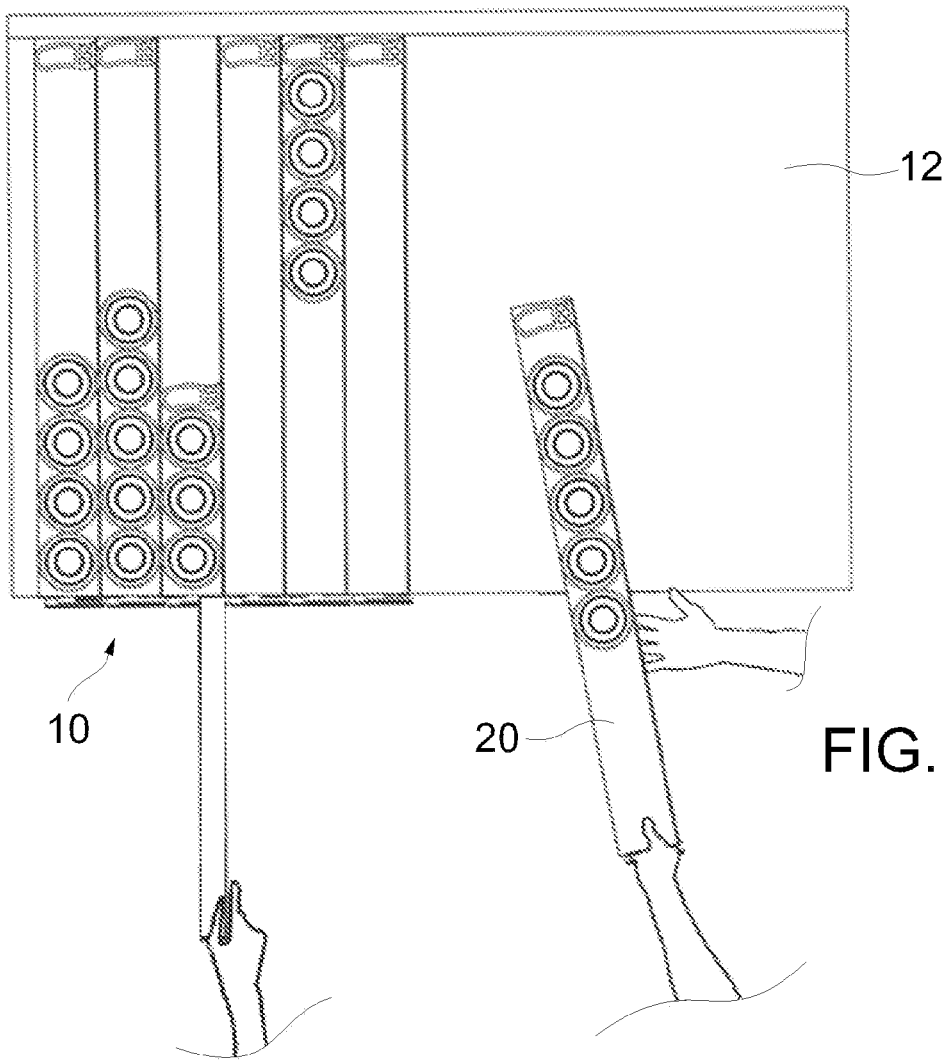
FIG. 2B is an overhead plan view of the shelf allocation and management system of FIG. 2A.

The operation of the unit 20 as described above would be useful in the case of product 14 stocking and rotation. The side divider 40 along with backstop 60 is drawn forward while the base 30 is held in stationary position which would allow the previously stocked products 14 to be rapidly brought forward to the front of unit 20. The side divider 40 and backstop 60 would then be returned to the starting or normal position at which point the entire managing unit 20 could be slid forward, or lifted off of the shelf 12 entirely, exposing the rear portion of the managing unit 20 thereby allowing new products 14 to be stocked behind the existing products 14 thereby achieving proper rotation of the products 14. FIGS. 2A and 2B illustrate a shelf reset or repositioning when the unit 20 is lifted off of the shelf 12. It will be understood by those of ordinary skill in the art that other than for shelf resets, a shelf typically will not be partially empty as shown in FIGS. 2A and 2B.

Products 14 in the product row associated with the shelf allocation and management unit 20 will rest on the top surface of the base 30 in such a way that generally at least half of the width of the bottom of the products 14 associated with the unit 20 is supported by direct contact with the top surface of the base 30. As shown in FIG. 11, a portion of the bottom of the products 14 may hang off the side of the base 30 opposite the side on which the side divider 40 is connected. In the case where the divider 40 is attached to the right side of base 30, the inside surface of the divider 40 will contact and will laterally support the right side of the row of products 14 associated with the unit 20 and the outside surface of the side divider 40 of a unit 20 immediately adjacent and to the left of the subject unit 20 shall make contact with and laterally contain the left side of the subject row of products 14.

The units 20 having a single side divider 40 provides an advantage in that the width of the unit 20 may be set so that, as shown in FIG. 11, the products 14 in the unit 20 are positioned on the base 30 so that a portion, perhaps 5-40%, of the width of the base of the products 14 extends beyond or hangs off of the side edge of the base 30 on the side opposite the side on which the side divider 40 is attached. For example, let us say that a unit 20 is configured with a side divider 40 attached to the right side of base 30 and the products 14, which in this example are 3.00" wide, are protruding approximately 0.40" off of the left side edge of the base 30. The products 14 will be laterally supported on the right by the side divider 40 and, assuming that the subject unit 20 is not an end unit in a system 10, the products 14 will be laterally supported on the left by the side divider 40 of a unit 20 positioned immediately adjacent and to the left. Provided that all of the units 20 in a system 10 are configured in the same way (with the dividers all on either the left or the right side of the units 20) then an absolute minimal amount of lateral distance between product 14 rows can be achieved because the only lateral distance separating immediately adjacent product 14 rows will be the thickness of one side divider 40. Structural integrity of the unit 20 may likely be achieved with a side divider 40 thickness of, for example, 0.040" to 0.080", and such a thin divider thickness would be considered desirable by the retailer. Were all of the units 20 in a system 10 to have two rather than one side divider 40 then the distance between immediately adjacent rows of products 14 would be at least the combined thickness of two side dividers 40 which may accumulate to a thickness deemed undesirable by retailers.

In a system 10, comprised of multiple units 20 the side dividers 40 of each unit 20 will all be coupled on either the right-hand side of the bases 30 or will all be coupled to the left-hand side of the bases 30. With a series of installed units 20 arranged in this manner, the products 14 associated with an individual shelf allocation and management unit 20 will be contained laterally both on the left and on the right and will therefore be prevented from moving outside of the product 14 row and inadvertently co-mingling with (different) products in the rows immediately to the left or the right.

Further, in the system 10, because of the "hang off" feature where a portion (perhaps 5-40%) of the bottom of many products 14 will extend beyond the edge of base 30, a unit 20 that features only one base 30 and divider 40 coupling position (fixed width setting) may be especially versatile as it may be used effectively for a large number of different (but generally similar) package 14 widths. Let us consider an example unit 20 that features a base 30 that is 2.85" in width and that features a divider 40 that is positioned flush to the side edge of base 30. This example unit 20 may be used for the common 13-15 ounce tin can (the most popular package used in United States dry grocery), and this 2.85"-wide unit 20 will also work with standard tuna fish cans, large cat food cans, many jams & jelly jars, many peanut butter jars, most pasta sauce jars and many small boxes such as the small Jell-O box and many rice-mix boxes. The significant advantage is that a single size of a fixed-width unit 20 may be used with a wide variety of products 14 which makes installation easier and faster because one size of unit 20 may be used for so many different products and because the unit 20 does not have to be adjusted or fitted to the product 14 as a time-consuming step in the installation process. Ordering of the units 20 will also be simpler for store managers because there will be few, possibly only two or three, rather than many sizes. Finally, because the units 20 in a system 10 all employ a base which supports the product 14 row, repositioning of products 14 (re-sets) are expedited as an entire row of products 14 may be moved en masse to another area of the store as opposed to the legacy practice of emptying the shelves 12 of all of the individual products 14 and then re-positioning those individual products 14 on a different shelf.

In a further embodiment, side dividers 40 can be attached to both the left side of the base 30 and the right side of the base 30 of each unit 20. This feature enables the end unit 20, on either the far left or far right in a system 10 of units 20 to be outfitted with two side dividers 40, one side divider 40 on the left side of the end unit 20 and another side divider on the right side of the end unit 20 so that the associated products 14 in this end unit 20 may be laterally supported both on the left and the right.

The top surface of the base 30 of each unit 20 shall have a low-friction surface such that the products 14 resting on the top surface of the base 30 shall slide freely both backward and forward along the length of the base 30. The low-friction surface may be achieved through either the use of a high lubricity coating on the top of the base or a series of ridges positioned along the top surface of the base parallel to the length of the base, or a combination of the two. This low-friction surface shall better allow the products 14 associated with the unit 20 to slide forward along the base 30 when the side divider 40, and attached backstop 60, is actuated and pulled forward along the base 30 with the intent to bring towards the front of the unit 20 all of the products 14 in the associated row.

Figure 13A:
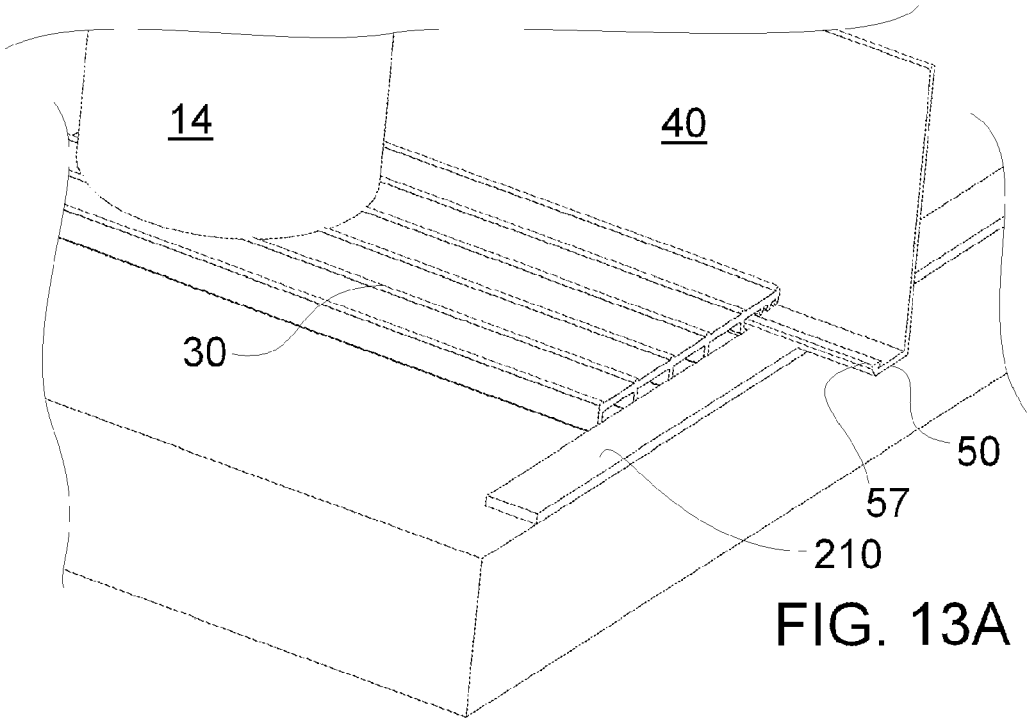
FIGS. 13A and B are views of further embodiments of the present invention showing an optional front strip affixed to the shelf for the purpose of preventing unwanted movement of the base.
Figure 13B:
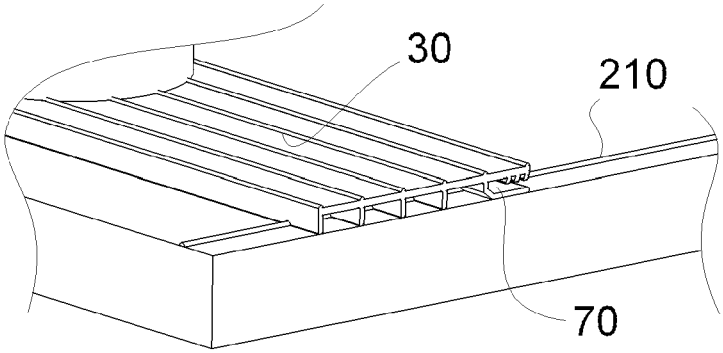

In a further embodiment of the system 10, as shown in FIGS. 13A and B, a narrow strip 210 of plastic or other material may be affixed to the top of shelf 12 at or near the front edge. The base 30 of a unit 20 may be positioned on shelf 12 behind this arresting strip 210 so that the front of the base 30 abuts against the rear edge of the arresting strip 210. The arresting strip 210 may be high enough to prevent the base 30 from moving forward beyond the arresting strip 210 but may be low enough to allow the divider 40 with connecting tab 50 to be pulled forward of the front shelf 12 edge as would occur during product 14 fronting. The arresting strip 210 may also be fashioned to mate with a notched opening or other receiving means along the front bottom of base 30, as shown in FIG. 13B, so that, once the arresting strip 210 and base 30 notch were mated, the base 30 would be free to move laterally but would be prevented from moving forward or backward.

In a further aspect of the invention, as shown in FIGS. 7A and 7B, the base 30 and divider 40 are formed as a integral single piece and thus are locked in position with respect to both lateral movement and forward and backward movement. This embodiment would feature a channel 150 on the top surface and in the approximate lateral center of the base 30 where the channel 150 shall run longitudinally front-to-back where the channel 150 is fashioned to receive a puller device 160 which shall be attached to a backstop 170, said puller 160 to be positioned within the channel 150 so that the puller 160 may slide within the channel 150 both backward and forward in a direction parallel to the length of the base 30 and perpendicular to the front shelf 12 edge. The backstop 170 attached to the puller 160 shall, when the puller 160 is positioned in the aforementioned channel 150 on the base 30, be at the rear end of the unit 20. The front of the puller device 160 shall be accessible and may be grasped from the front of the unit 20 so that once some of the products 14 in the product 14 row are depleted, such as by shoppers selecting items for purchase, the front of the puller 160 device may be grasped and pulled forward thereby bringing the attached backstop 170 forward thereby bringing forward the rearmost product 14 in the product 14 row such that all of the remaining products in the product row may be brought towards the front edge of the unit 20.

Figure 20:
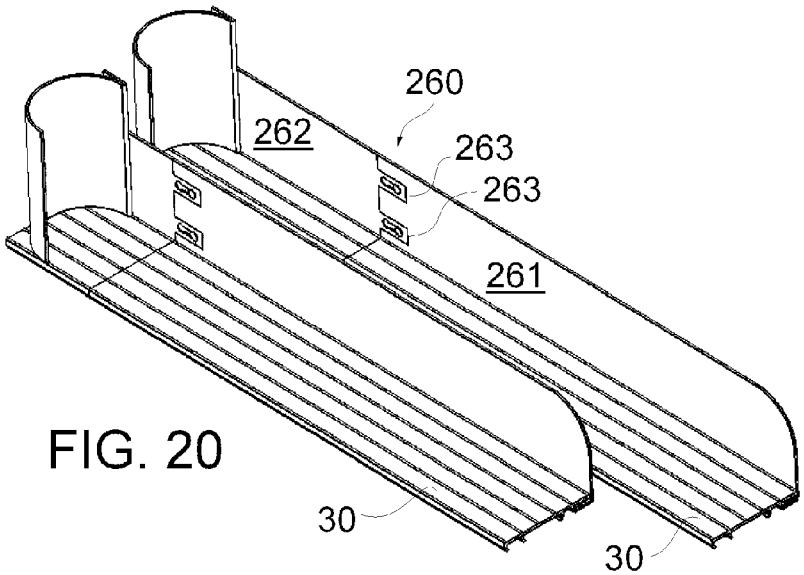
FIG. 20 is a perspective view of one aspect of the present invention showing of an optional adjustable divider that can be configured to lengthen or shorten the effective length of the divider of a shelf allocation and management unit.
Figure 21:
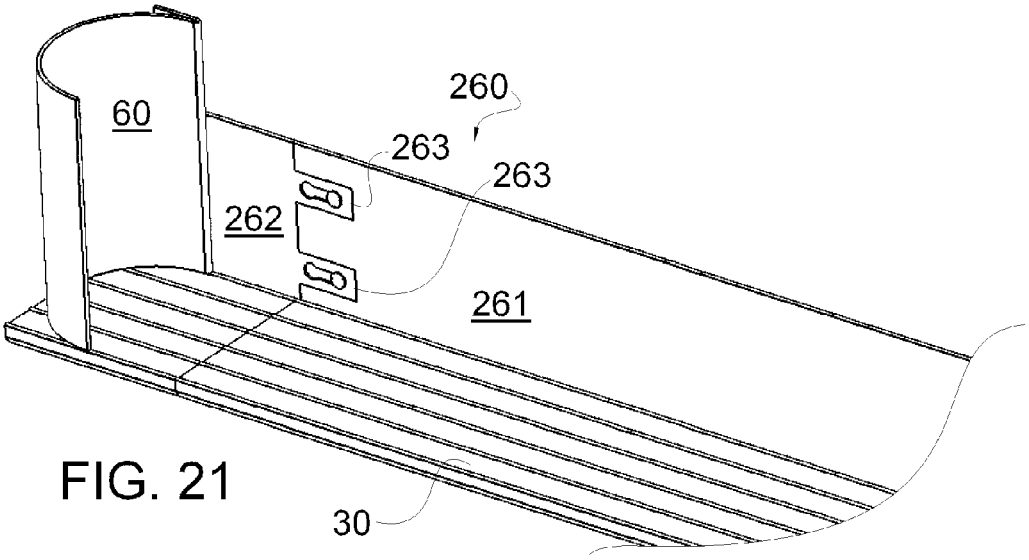
FIG. 21 is an enlarged view of the optional adjustable divider shown in FIG. 20.

In a further aspect of the invention the base 30 and side divider 40 (and puller 160) are adjustable in length so that the unit 20 can be adjusted to fit shelves 12 of different depths. As shown in FIG. 19 a connector piece 250 allows two or more base 30 sections of varying lengths to be joined together or de-coupled so that the base 30 may be lengthened or shortened. The connector 250 may take the form of a male piece, approximately 4" in length, approximately 1.30" in width and approximately 0.10" in thickness that fits securely with a friction slip fit into features presenting a female opening on the bottom of the base 30. As shown in FIGS. 20 and 21 a length-adjustable divider 260 may likewise be used to allow adaption of the unit 20 to varying shelf depths. This length-adjustable divider 260 is comprised of a front divider section 261 that connects to a rear divider section 262 (with integral backstop 60) using a conventional snap fit connection 263. The puller 160 may similarly be comprised of multiple sections coupled and de-coupled together to allow for adjustability in length. Other methods of lengthening and shortening the base 30 may be used such as a telescoping mechanism with stops at which the base 30 may be locked at various lengths. The adjustability of all components of the unit 20 may further be achieved by scoring so that each section could be shortened (possibly by snapping off) in increments of possibly 0.5".

In a further aspect of the invention as shown in FIGS. 8A and B the face plate 230 may be used as a location for brand, price and other identifying information associated with the products 14 contained in the unit 20. The face plate 230 may be configured to receive conventional interchangeable price tags of the variety in common use in supermarkets. In a further aspect the face plate 230 may be permanently marked with brand or other merchandise information and the face plate 230 may be removeably attached to the front of the unit 20 so that the face plate 230 and product information may be thereby changed. A face plate 230 displaying product information would be advantageous in that valuable identifying and price information would remain immediately adjacent to the products 14 in the unit 20 at all times as contrasted with the legacy practice of affixing the product 14 label on the front edge of the shelf 12 with no way of securing the products 14 associated with that label in a position consistently adjacent to the label potentially resulting in confusion where shoppers cannot easily ascertain the price and identification of the products 14.

The side divider 40, at least when combined with a side divider 40 of an immediately adjacent unit 20 (or when combined with a second side divider 40 coupled to a unit 20 in the case of an end unit 20 of a system 10) provides lateral support of the products 14. Lateral support of the products 14 is useful in that it confines the product 14 row(s) associated with a given managing unit 20 and maintains the row in a straight line both when new products 14 are placed on the shelf 12, as occurs when stocking, and when the product row is brought forward by the backstop 60 (or backstop 170), as occurs when the side divider 40 is drawn forward. Lateral support also discourages the products 14 from tipping or falling to the side and interfering with products 14 in adjoining rows. Further, lateral support prevents products in one row associated with a managing unit 20 from co-mingling with (different) products 14 in immediately adjacent rows. Effective lateral support of the product 14 can be achieved with a divider that is substantially lower than the top of the product 14, or, if the products 14 are stacked one-on-another, the top of the product 14 stack.

Due to the symmetrical nature of many products 14 the side dividers 40 can be of relatively low height and still provide substantial lateral product 14 support. In order to provide some quantitative guidelines, substantive lateral support within the meaning of this application will mean a side divider height of at least 15% of the height of the product 14 or product stack height. If the product or product stack is relatively stable than substantive lateral support would mean approximately 15-50% of the height; conversely if the product 14 or product stack has low stability, then substantive lateral support would mean approximately 20-90% of the height.

In order to reduce the degree to which the side dividers 40 might obstruct the side view (of a store customer) of the product 14 or product stack, the front of the side divider 40, as shown in FIG. 5, may be swept back at an angle so that towards the extreme front end of the side divider 40 the top of side divider 40 may be, for example, 1.00" high and would attain increasingly greater height as the top of side divider 40 extended rearward and would reach its full height (3.00" for example) at a point, for purpose of illustration, 5.00" rearward of the front of side divider 40.

Figure 9:
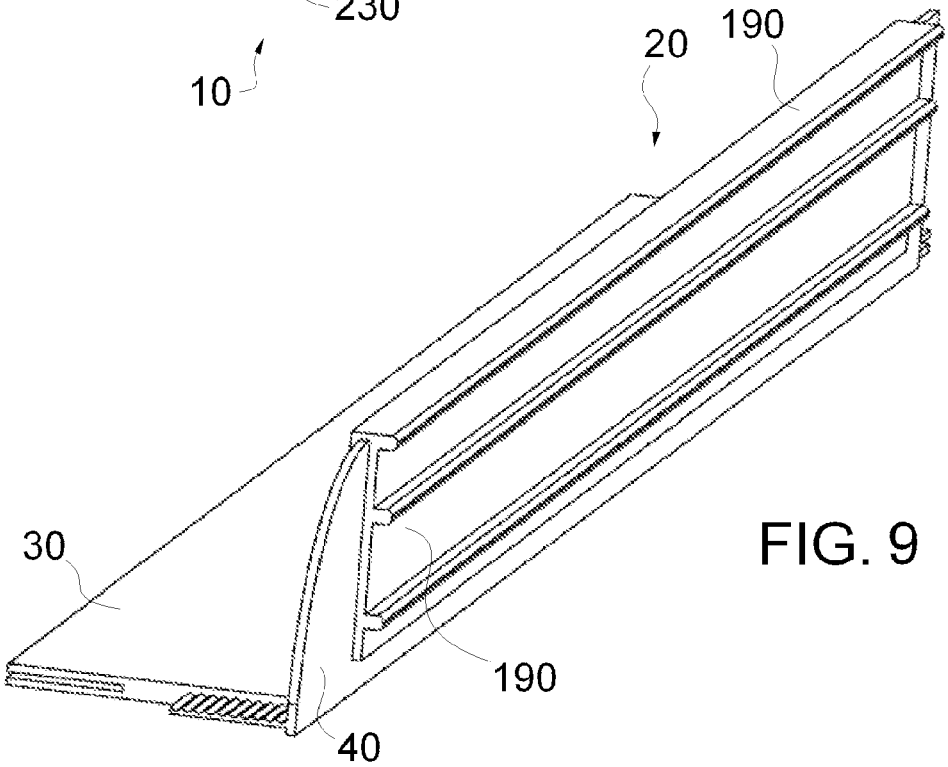
FIG. 9 is a perspective view of a further embodiment of the present invention showing a side divider attachment adapted to displace extra lateral space between product rows.
Figure 14A:
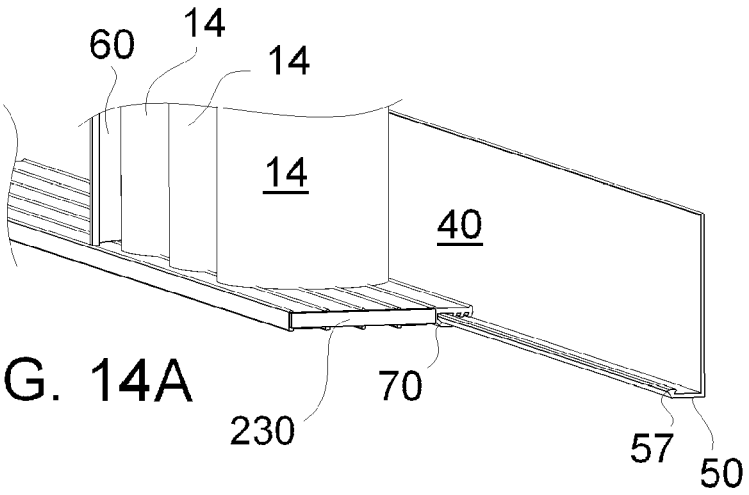
FIGS. 14A and B are views of further embodiments of the present invention where a face plate is affixed to the front edge of the base.

In a further embodiment of the present invention as shown in FIG. 9, a thickness augmenter 190 may be attached to side divider 40 which will be useful in those cases where objectionable gaps exist between product 14 rows that cannot be effectively reduced by either re-positioning units 20 or, in the case of a width-adjustable unit 20, by re-adjusting the width settings of units 20. The thickness augmenter 190 may be in the form, as shown in FIG. 9, of a vertical panel of equivalent length and height of side divider 40. This vertical panel or thickness augmenter 190 would feature some form of attachment device so that the thickness augmenter 190 may be removably attached to side divider 40 thereby increasing the lateral space occupied by side divider 40 and filling the objectionable gap between product 14 rows. The thickness augmenter 190 may also take the form of a thicker side divider 40, for example 0.30" thick. Whatever form it takes, the thickness augmenter 190 may increase the lateral space between product 14 rows occupied by the side divider 40 from, for example 0.060" to, for example, 0.40".

Figure 22:
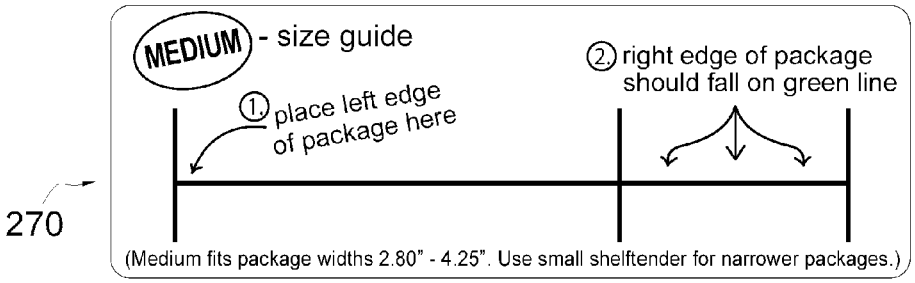
FIG. 22 is a plan view of an optional size guide indicating the widths of products that may be effectively displayed on the unit.

In a further embodiment as shown in FIG. 22 a guide 270 indicating the range of product 14 widths that may be effectively merchandised on the unit 20 is displayed on the unit 20, preferably on the inside of the divider 40. This "size guide" 270 serves to help store clerks rapidly determine if they have the correct size of unit 20 (i.e. unit width) to merchandise the product 14 in question. The "size guide" 270 may take the form of an affixed label or may be printed on the unit 20 or may be stamped or embossed as part of the manufacturing process.

Figure 23:
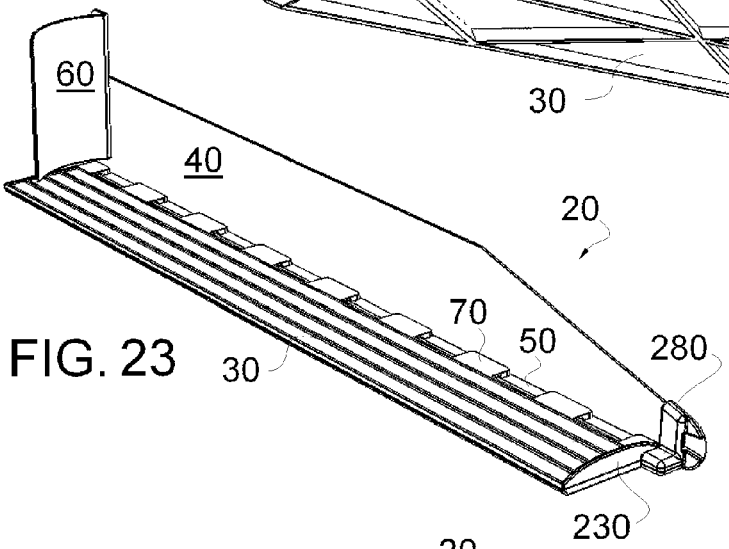
FIG. 23 is a view of an optional handle that protrudes forward of the front of the unit to better enable actuating the fronting feature.

In a further embodiment as shown in FIG. 23 the front end of the divider 40 (or puller 160) may be outfitted with a handle 280. The handle 280 shall protrude forward perhaps 0.75", but anywhere from 0.20" to 2.50", of the front of the base 30 and face plate 230. The handle serves as an easily accessible and more ergonomic means of grasping the divider 40 (or puller 160) for purpose of actuating the fronting feature and serves, by virtue of its prominent visibility and ergonomic design, to communicate that the unit 20 includes a fronting feature to those (store clerks) who may not otherwise intuit the existence of this key feature.

Figure 25:
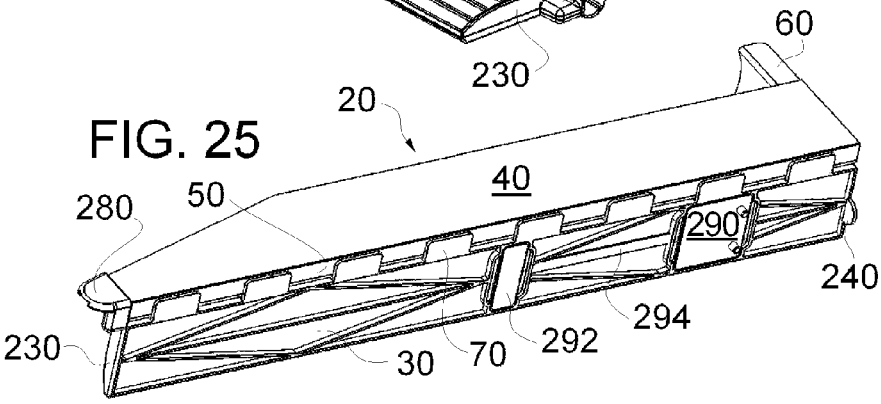
FIG. 25 illustrates a base incorporating an automated inventory measuring system.

In a further embodiment, as shown in FIG. 25, the unit 20 may be outfitted with a means for measuring the number of products 14 situated on the unit 20. This measuring means may be comprised of a sensor 290, a transmitter 292 and a wire 294 connecting the two. The sensor 290 may take the form of an optical sensor, weighing device or product position sensor, or a combination of these. FIG. 25 shows an embodiment where the sensor 290 employs two protruding spring-loaded pistons that, when retracted (pushed in by the weight of products 14 on the base 30 of a full unit 20), would be registered within the sensor 290 as the unit 20 being full, and when the pistons were extended (caused by the depletion of the products 14 and attendant reduction of weight on base 30) would be registered as empty. In many stores inventory is counted by a store clerk or manager who must walk along the store shelves and visually inspect the rows associated with a given variety of product 14. If the amount of product 14 appears to be low then a case of new inventory is ordered. This method of inventory measuring and ordering is time consuming as each individual product 14 variety must be visually inspected, and there are as many as 20,000-40,000 varieties of products 14 in a typical store. Further, it is imprecise as the products 14 at the rear of the shelf are frequently obstructed from view by those products 14 at the front, plus products 14 of one variety may have inadvertently moved to the left or right of their designated area so that a product 14 that appears to be depleted may actually be well-stocked and vice versa. An inventory measuring system integral to the unit 20 would either visually display or electronically communicate the inventory count of a product 14 variety so that, at a minimum, store personnel would no longer be forced to rely on imprecise and time-consuming visual counting, and, at the ideal, the inventory count would be electronically and automatically transmitted to a central computer system thereby eliminating altogether the need for at-shelf inventory inspection. The unit 20 provides an effective platform for similar inventory control devices. For example the sensor 290 may be designed as a pressure transducer or other weight sensor that is calibrated to the products (possibly through a unit 20 calibration step in which the weights of one, two, three and full amounts are calibrated during unit set up). Other known proximity sensors could also be implemented to detect the amount of products on the base. Alternatively optical sensors scanning the row could be implemented with associated openings in the base as desired locations. The sensor construction is likely known in the art, and the present invention provides a particularly advantageous platform for effectively deploying such a system.

The various features of the present invention can form improved shelf management systems outside of the specific illustrated embodiments. For example, the positive row separation, the fact that a single fixed-width unit 20 may be used for a wide variety of products 14, the easy width adjustability in some embodiments and the minimal lateral displacement of the dividers of the present invention can yield improved shelf management systems when applied to the gravity systems and to the spring-biased backstops of the prior art.

In a still further modification of the units 20, the side divider 40 may include openings therein to facilitate viewing of the products 14 and/or for stylized purposes and/or to reduce the amount of plastic required for manufacture of the managing unit 20 and/or to facilitate air flow around the products 14 such as in the case where products 14 require refrigeration.

It should be apparent that the shelf management systems 10 of the present invention will work with cans, jars and boxes. Further, the system 10 can function as an easy-to-install static (non-fronting) row divider system on flat shelves and can function as easy-to-install static row divider system on inclined/gravity shelves. Further, in the present system 10 the existence of the base 30 locks in the lateral position of the units 20, and the associated row or product selling space, and ensures that, even when empty, the units 20 will not migrate too far out of position to the left or right.

Figure 24:
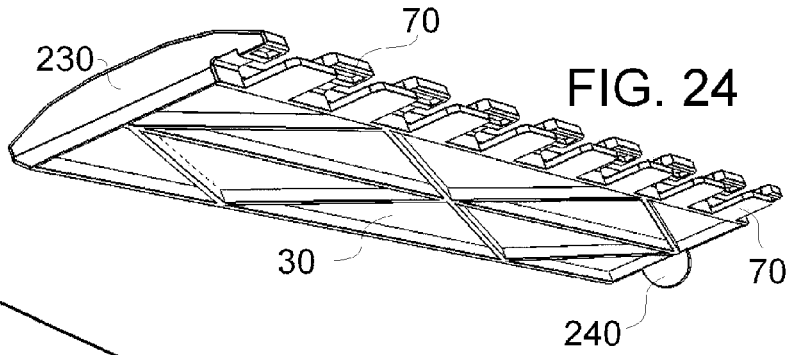
FIG. 24 is a view of an optional injection molded base design.

As shown in FIGS. 24 and 25 the base 30 may be manufactured via injection molding in order to allow more cost effective and rapid production and to better allow the inclusion of features to provide for better function of the base 30 and therefore unit 20. The base 30 shown in FIGS. 24 and 25 is one possible design affording injection molding. To make injection molding more rapid and cost-effective the injection molding tool should be of the "open-and-shut" variety rather than a more complex and expensive tool that requires secondary or "side action." The use of the alternating teeth in the design of channel 70 as shown in FIGS. 24 and 25 would enable the base 30 to be injection molded with an open-and-shut injection molding tool whereas the base 30 shown in FIG. 16 could not practicably be injection molded (but could only feasibly be made via extrusion).

It is understood, therefore, that this invention is not limited to the particular embodiments disclosed, but it is intended to cover modifications that are within the spirit and scope of the invention, as defined by the appended claims and equivalents thereto.

What is claimed is:

1. A bottom supporting shelf allocation and management system for allocating shelf space among rows of products, the system comprises:

a plurality of adjacent shelf allocating and managing units, each unit associated with at least one row of products, wherein each unit includes:

a base adapted to rest on a shelf and to support the at least one row of products, a single side divider removeably attached to the base and extending upward from a side edge of the base wherein the at least one row of products associated with the unit may be positioned on the base adjacent the side divider, a backstop attached to a rear inside of the side divider and extending across the base and configured to push products forward along the base, wherein the side divider is configured to slide forward and backward along a length of the base while the base remains stationary and where the backstop attached to the side divider will, when the side divider is drawn forward, make contact with a rearmost product resting on the base and will push the rearmost product and any other products on the base forward in response to the forward movement of the side divider.

2. The bottom supporting shelf allocating and management system according to claim 1 where side dividers of different heights, bases of different widths, and backstops of different heights may be selected to accommodate products of different heights and/or widths.

3. The bottom supporting shelf allocating and management system according to claim 1 wherein the backstop can be adjusted in width.

4. The bottom supporting shelf allocating and management system according to claim 1 wherein the base can be adjusted in length.

5. The bottom supporting shelf allocating and management system according to claim 1 wherein the base includes at least one channel on the side edge least one side of the base configured so that the side divider may be attached to the side edge of the base via the channel.

6. The bottom supporting shelf allocating and management system according to claim 1 where an attachment mechanism between the base and side divider allows for adjustment of a distance between an inside surface of the divider and the side edge of the base allowing a variety of width positions to be selected so that products of various widths might be merchandised on the unit.

7. The bottom supporting shelf allocating and management system according to claim 1 further including a face plate attached to a front end of the base configured to act as a stop that prevents products from sliding off the front end of the base during product fronting.

8. The bottom supporting shelf allocating and management system according to claim 1 further including a row shortening device configured to be removably attached to the backstop so that an effective depth of the unit may be decreased.

9. The bottom supporting shelf allocating and management system according to claim 1 further including displayed guide indicia identifying a range of product widths that may be effectively merchandized on the unit.

10. The bottom supporting shelf allocating and management system according to claim 1 further including a sensor configured for detecting a number of products on the base, and a transmitter for selectively transmitting a sensed number of products on the base.

11. The bottom supporting shelf allocating and management system according to claim 1 further including an arresting member affixed to a top front edge of the shelf to which a front edge of the base abuts in such a manner to allow the divider to be actuated for product fronting while preventing the base from sliding forward of the front edge of the shelf when the divider is pulled forward.

12. The bottom supporting shelf allocating and management system according to claim 1 wherein the base includes a channel running along and parallel to the length of the base.

13. The bottom supporting shelf allocating and management system according to claim 12 wherein the divider includes a male connecting tab designed to be received in the channel of the base.

14. The bottom supporting shelf allocating and management system according to claim 13 wherein the channel includes a plurality of downward projections.

15. The bottom supporting shelf allocating and management system according to claim 13 wherein the channel is formed with a plurality of alternating teeth.

* * * * *